US011331678B2

(12) United States Patent
Takezawa et al.

(10) Patent No.: US 11,331,678 B2
(45) Date of Patent: May 17, 2022

(54) CHARGING APPARATUS AND PRECIPITATOR

(71) Applicant: Samsung Electronics Co., Ltd., Suwon-si (KR)

(72) Inventors: Manabu Takezawa, Yokohama (JP); Seiro Yuge, Yokohama (JP); Daisuke Fukuoka, Yokohama (JP); Kazutoshi Takenoshita, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 598 days.

(21) Appl. No.: 16/233,884

(22) Filed: Dec. 27, 2018

(65) Prior Publication Data

US 2019/0193089 A1 Jun. 27, 2019

(30) Foreign Application Priority Data

Dec. 27, 2017 (JP) ..... JP2017-251650
Nov. 15, 2018 (KR) ..... 10-2018-0140753

(51) Int. Cl.
*B03C 3/41* (2006.01)
*B03C 3/12* (2006.01)
(Continued)

(52) U.S. Cl.
CPC ..... *B03C 3/41* (2013.01); *B03C 3/08* (2013.01); *B03C 3/12* (2013.01); *B03C 3/155* (2013.01);
(Continued)

(58) Field of Classification Search
CPC combination set(s) only.
See application file for complete search history.

(56) References Cited

U.S. PATENT DOCUMENTS 3,747,299 A * 7/1973 Chiang ..... B03C 3/12 95/79
5,037,456 A * 8/1991 Yu ..... B03C 3/45 96/76
(Continued)

FOREIGN PATENT DOCUMENTS

CN 101745463 A 6/2010
CN 107107074 A 8/2017
(Continued)

OTHER PUBLICATIONS

Supplementary Partial European Search Report in connection with European Application No. 18897739.1 dated Dec. 3, 2020, 16 pages.
(Continued)

*Primary Examiner* — Christopher P Jones
*Assistant Examiner* — Sonji Turner

(57) ABSTRACT

Disclosed herein is a charging apparatus and precipitator. The charging apparatus includes a plurality of counter electrodes formed in a plate shape and arranged in a direction intersecting with a ventilation direction to allow respective surfaces thereof to follow the ventilation direction, and a plurality of high voltage electrodes formed in a wire shape and installed between the plurality of counter electrodes. The plurality of counter electrodes includes a first counter electrode having a first electrode area, and a second counter electrode having a second electrode area less than the first electrode area. The first counter electrode and the second counter electrode are alternately arranged.

19 Claims, 34 Drawing Sheets

EXAMPLE 1

(51) Int. Cl.

| | |
|---|---|
| ***B03C 3/08*** | (2006.01) |
| ***B03C 3/155*** | (2006.01) |
| ***B03C 3/36*** | (2006.01) |
| ***B03C 3/38*** | (2006.01) |

(52) U.S. Cl.
CPC ..... *B03C 3/368* (2013.01); *B03C 3/38* (2013.01); *B03C 2201/04* (2013.01)

(56) References Cited

U.S. PATENT DOCUMENTS

| | | | | |
|---|---|---|---|---|
| 5,055,118 | A * | 10/1991 | Nagoshi | B03C 3/08 96/88 |
| 7,724,492 | B2 * | 5/2010 | Botvinnik | B03C 3/41 361/230 |
| 8,597,415 | B2 * | 12/2013 | Noh | B03C 3/368 96/60 |
| 10,537,901 | B2 * | 1/2020 | Lee | B03C 3/12 |
| 10,668,422 | B2 * | 6/2020 | Kim | B01D 46/4245 |
| 2009/0053113 | A1 | 2/2009 | Mai | |
| 2011/0197768 | A1 | 8/2011 | Motegi et al. | |
| 2012/0160106 | A1 | 6/2012 | Ji et al. | |
| 2015/0013541 | A1 * | 1/2015 | Vandenbelt | B03C 3/08 96/98 |
| 2017/0209871 | A1 | 7/2017 | Luo | |
| 2017/0341087 | A1 | 11/2017 | Yuge et al. | |

FOREIGN PATENT DOCUMENTS

| | | | | |
|---|---|---|---|---|
| EP | 1434013 | A2 | 6/2004 | |
| EP | 2316575 | A1 | 5/2011 | |
| JP | 2005205405 | A * | 8/2005 | B03C 3/41 |
| JP | 20050205405 | A | 8/2005 | |
| JP | 2010-022999 | A | 2/2010 | |
| KR | 10-2009-0023148 | A | 3/2009 | |
| WO | 2010038872 | A1 | 4/2010 | |
| WO | 20120144211 | A1 | 10/2012 | |
| WO | 2017212688 | A1 | 12/2017 | |

OTHER PUBLICATIONS

International Search Report dated Apr. 12, 2019 in connection with International Patent Application No. PCT/KR2018/016794, 3 pages.
Supplementary European Search Report dated Mar. 10, 2021 in connection with European Patent Application No. 18 89 7739, 15 pages.
The First Office Action dated Nov. 26, 2021, in connection with Chinese Application No. 201880084050.9, 12 pages.
Observation with respect to First Office Action dated Nov. 26, 2021, in connection with Chinese Application No. 201880084050.9, 4 pages.

* cited by examiner

FIG.4

| | COUNTER ELECTRODE | | | | | | | DUST COLLECTION EFFICIENCY (%) | | | OZONE CONCENTRATION(ppb) | | |
|---|---|---|---|---|---|---|---|---|---|---|---|---|---|
| | ARRANGEMENT | COMBINATION | | SHAPE OF COUNTER ELECTRODE B~ H | | | | DISCHARGE CURRENT(μA) | | | DISCHARGE CURRENT(μA) | | |
| | | | | SHAPE OF OPENING | DIAMETER/ WIDTH(mm) | POSITION | RATIO(%) | 150 | 250 | 450 | 150 | 250 | 450 |
| EXAMPLE 1 | ALTERNATE ARRANGEMENT | A | B | CIRCLE | 3Φ | DOWNSTREAM SIDE | 13.8 | 98.88 | 99.78 | 99.96 | 2.2 | 3.8 | 7.0 |
| EXAMPLE 2 | ALTERNATE ARRANGEMENT | A | C | CIRCLE | 3Φ | FRONT SURFACE | 27.6 | 92.48 | 97.82 | 99.33 | 2.2 | 4.1 | 7.2 |
| EXAMPLE 3 | ALTERNATE ARRANGEMENT | A | D | RECTANGLE | 5 | DOWNSTREAM SIDE | 50.0 | 95.99 | 98.67 | 99.32 | 2.5 | 4.9 | 7.8 |
| EXAMPLE 4 | ALTERNATE ARRANGEMENT | A | E | CIRCLE | 0.25Φ | FRONT SURFACE | 10.0 | 84.60 | 96.77 | 99.53 | 2.0 | 3.7 | 6.7 |
| EXAMPLE 5 | ALTERNATE ARRANGEMENT | A | F | CIRCLE | 0.75Φ | FRONT SURFACE | 36.0 | 97.08 | 99.77 | 99.96 | 3.0 | 6.0 | 8.8 |
| EXAMPLE 6 | ALTERNATE ARRANGEMENT | A | G | CIRCLE | 1.5Φ | FRONT SURFACE | 50.0 | 96.30 | 99.72 | 99.94 | 2.4 | 4.3 | 7.0 |
| EXAMPLE 7 | ALTERNATE ARRANGEMENT | A | H | CIRCLE | 6Φ | DOWNSTREAM SIDE | 30.4 | 93.53 | 98.81 | 99.89 | 2.1 | 3.8 | 7.9 |
| COMPARATIVE EXAMPLE 1 | HOMOGENEOUS ARRANGEMENT | A | A | CIRCLE | | | 0.0 | 78.79 | 95.08 | 99.31 | 2.6 | 3.9 | 7.1 |
| COMPARATIVE EXAMPLE 2 | HOMOGENEOUS ARRANGEMENT | B | B | CIRCLE | 3Φ | DOWNSTREAM SIDE | 13.8 | 88.21 | 96.01 | 99.11 | 2.3 | 3.8 | 8.0 |
| COMPARATIVE EXAMPLE 3 | HOMOGENEOUS ARRANGEMENT | C | C | CIRCLE | 3Φ | FRONT SURFACE | 27.6 | 82.35 | 93.57 | 98.99 | 2.0 | 3.1 | 8.0 |

FIG. 9

| | COUNTER ELECTRODE | | | | | | | DUST COLLECTION EFFICIENCY (%) | | | OZONE CONCENTRATION(ppb) | | |
|---|---|---|---|---|---|---|---|---|---|---|---|---|---|
| | ARRANGEMENT | COMBINATION | | SHAPE OF COUNTER ELECTRODE B',D' | | | | DISCHARGE CURRENT(μA) | | | DISCHARGE CURRENT(μA) | | |
| | | | | SHAPE OF OPENING | DIAMETER/ WIDTH(mm) | POSITION | RATIO (%) | 150 | 250 | 450 | 150 | 250 | 450 |
| EXAMPLE 1 | HOMOGENEOUS ARRANGEMENT | A | A | - | | | 0.0 | 79.79 | 95.08 | 99.31 | 2.6 | 3.9 | 7.1 |
| EXAMPLE 4 | ALTERNATE ARRANGEMENT | A | B' | CIRCLE | 3Ø | UPSTREAM SIDE | 13.8 | 82.30 | 95.53 | 99.52 | 3.0 | 4.0 | 7.8 |
| EXAMPLE 5 | ALTERNATE ARRANGEMENT | A | D' | RECTANGLE | 5 | UPSTREAM SIDE | 50.0 | 75.56 | 92.55 | 97.76 | 2.0 | 4.0 | 7.0 |

FIG. 15

| | HIGH VOLTAGE ELECTRODE | | COUNTER ELECTRODE | | | DUST COLLECTION EFFICIENCY (%) | | | OZONE CONCENTRATION(ppb) | | |
|---|---|---|---|---|---|---|---|---|---|---|---|
| | | | | | | DISCHARGE CURRENT(μA) | | | DISCHARGE CURRENT(μA) | | |
| | MATERIAL | SHAPE(μm) | ARRANGEMENT | COMBINATION | | 150 | 250 | 450 | 150 | 250 | 450 |
| EXAMPLE 8 | W | RACING TRACK SHAPE / 50 x 150 | HOMOGENEOUS ARRANGEMENT | A | A | 96.23 | 98.60 | 99.37 | 2.0 | 3.4 | 5.5 |
| EXAMPLE 9 | W | RACING TRACK SHAPE / 50 x 150 | ALTERNATE ARRANGEMENT | A | B | 97.75 | 99.00 | 99.55 | 1.8 | 3.1 | 5.1 |
| COMPARATIVE EXAMPLE 1 | W | CIRCLE / 90Φ | HOMOGENEOUS ARRANGEMENT | A | A | 79.79 | 95.08 | 99.31 | 2.6 | 3.9 | 7.1 |
| COMPARATIVE EXAMPLE 6 | SUS | SQUARE / 50 x 70 | HOMOGENEOUS ARRANGEMENT | A | A | 74.08 | 95.44 | 98.89 | 1.5 | 3.7 | 7.0 |
| COMPARATIVE EXAMPLE 7 | SUS | RECTANGLE / 50 x 150 | HOMOGENEOUS ARRANGEMENT | A | A | 72.99 | 96.05 | 99.19 | 1.3 | 3.5 | 6.1 |

CHARGING APPARATUS AND PRECIPITATOR

CROSS-REFERENCE TO RELATED APPLICATIONS

This application is based on and claims priority under 35 U.S.C. § 119 to Japan Patent Application No. 2017-251650, filed on Dec. 27, 2017, in the Japan Intellectual Property Office, and Korean Patent Application No. 10-2018-0140753, filed on Nov. 15, 2018, in the Korean Intellectual Property Office, the disclosure of which is incorporated by reference herein in its entirety

BACKGROUND

1. Field

Embodiments of the present disclosure relate to a charging apparatus and a precipitator.

2. Description of Related Art

Air cleaners and air conditioners are equipped with a precipitator to charge suspended particles by using a discharge.

The precipitator includes a charger charging suspended particles by discharging, and a dust collector collecting charged suspended particles. As for the charger of the precipitator, a high voltage of several kV is applied to generate a discharge between a high voltage (discharge) electrode and a counter (ground) electrode. When a discharge current flowing between the high voltage electrode and the counter electrode becomes large to obtain the high dust collection efficiency, ozone ($O_3$) may be easily generated according to the discharge. The ozone has a unique smell and thus when the ozone is discharged to the indoor, it is required that the ozone level is below the environmental standard (50 ppb).

Japanese Unexamined Patent Application Publication No. 6-182255 (hereinafter Patent document 1), discloses an electrostatic precipitator provided with an ionizing portion and a dust collector. The ionizing portion has a discharging wire disposed in a direction substantially perpendicular to an airflow direction, and a ground electrode formed in a shape for transmitting the airflow, and disposed on a position, which allows a space with the discharging wire to be a charged space having uniform electric field intensity. The dust collector is disposed on the downstream side of the ionizing portion in the air flow.

International Publication No. 2011/034326 (hereinafter Patent document 2), discloses a precipitator provided with a supporting frame provided with an outer frame defining a hollow through-portion, an emitter electrode portion detachably provided within the outer frame of the supporting frame, and including a connecting member crossing the through-portion and having a plurality of rod electrodes connected thereto, and a collector electrode portion detachably disposed within the outer frame of the supporting frame, and including a metal plate electrode installed so as to face the arranged rod electrodes and defining a plurality of perforated holes so as to form an ionic breeze of ambient air and to collect suspended matter from the air.

Japanese Patent Application Laid-Open No. 2010-22999 (hereinafter Patent document 3), discloses a charging apparatus for an electrostatic precipitator, wherein the charging apparatus is provided with a charger charging the dust in the air by generating a corona discharge between a discharge electrode and a counter electrode opposite to the discharge electrode, and the discharge electrode is a plate shape and disposed between the counter electrodes with a distance, and the voltage is applied according to the distance.

SUMMARY

When a precipitator is continuously operated for a long period of time, the generation of ozone needs to be suppressed to prevent the irritating odor, uncomfortable feeling and the pain of the nose and throat while still maintaining the high dust collecting efficiency. Therefore, it is required to improve the charging efficiency of the suspended particles in a charger of the precipitator without increasing a discharge current.

It is an aspect of the present disclosure to provide a charging apparatus capable of improving charging efficiency of suspended particles while suppressing an ozone concentration that is generated.

Additional aspects of the disclosure will be set forth in part in the description which follows and, in part, will be obvious from the description, or may be learned by practice of the disclosure.

In accordance with an aspect of the disclosure, a charging apparatus includes a plurality of counter electrodes formed in a plate shape and arranged in a direction intersecting with a ventilation direction to allow respective surfaces thereof to follow the ventilation direction, and a plurality of high voltage electrodes formed in a wire shape and installed between the plurality of counter electrodes. The plurality of counter electrodes includes a first counter electrode having a first electrode area, and a second counter electrode having a second electrode area less than the first electrode area. The first counter electrode and the second counter electrode are alternately arranged.

The second counter electrode may include a through hole.

The second counter electrode may be provided such that an opening degree is higher in a leeward side than a windward side.

The second counter electrode may be provided such that a center of gravity of the through hole is placed on the leeward side than the high voltage electrode.

The second counter electrode may be formed in a plate shape such that a width thereof is narrower in the ventilation direction than the first counter electrode.

The second counter electrode may be disposed such that a distance between an end portion of the windward side and an end portion of the windward side of the first counter electrode is less than a distance between an end portion of the leeward side and the leeward side of the first counter electrode.

A ratio of the second electrode area to the first electrode area may be greater than 50% and less than 90%.

When a plane shape of the through hole is a circle, a diameter may be equal to or greater than 2.5% and equal to or less than 60% of a width of the second counter electrode in the ventilation direction.

The high voltage electrode may be disposed on the windward side or centered in the ventilation direction.

The high voltage electrode may have a circular cross section having a diameter of equal to or greater than 20 μm and equal to or less than 300 μm.

The high voltage electrode may include a cross section in which a corner of a rectangle has an arc shape.

The high voltage electrode may have the arc shaped corner having a curvature radius that is 5% or greater and 50% or less of a length of a short side of the cross section.

The high voltage electrode may be provided such that a short side of the cross section is 50 μm or greater and 100 μm or less.

The high voltage may be provided such that a ratio of a length of a long side thereof exceeds 1 and equal to or less than 4 with respect to a length of the short side.

The high voltage electrode may include one of a metal having any one of tungsten, copper, nickel, stainless steel, zinc and iron, an oxide or an alloy containing the metal as a main component, and a material formed by plating a precious metal such as silver, gold, or platinum, on a surface of the metal or the oxide containing the metal as a main component.

In accordance with an aspect of the disclosure, a charging apparatus includes a plurality of counter electrodes formed in a plate shape and arranged in a direction intersecting with a ventilation direction to allow respective surfaces thereof to follow the ventilation direction, and a plurality of high voltage electrodes formed in a wire shape and installed between the plurality of counter electrodes. The high voltage electrode includes a cross section in which a corner of a rectangle has an arc shape The high voltage electrode may have an arc shaped corner having a curvature radius that is 5% or greater and 50% or less of a length of a short side of the cross section.

In accordance with an aspect of the disclosure, a precipitator includes a charger including the charging apparatus, and a dust collector or a dust collection filter disposed in a leeward side of the charger and configured to collect charged suspended particles floating in the air flow passed through the charger.

The dust collector may include a high voltage electrode formed in a plate shape and coated with a film formed of an insulating material, and a counter electrode formed in a plate shape having conductivity, and the high voltage electrode and the counter electrode may be alternately stacked.

The dust collection filter may be electret-processed.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of embodiments, taken in conjunction with the accompanying drawings of which:

FIG. 4 is a table illustrating dust collection efficiency and an ozone concentration with the respective discharge currents of a precipitator having a counter electrode of a charger and the charger in the example 1, the comparative example 1, other example and comparative example;

FIG. 9 is a table illustrating dust collection efficiency and an ozone concentration with the respective discharge current of a precipitator having the counter electrode of the charger, and the charger in the comparative example 1 and the comparative examples 4 and 5;

FIG. 15 is a table illustrating dust collection efficiency and an ozone concentration with the respective discharge currents of a precipitator having a high electrode and a counter electrode of a charger and the charger in the example 8, the comparative example 1, other example and comparative example;

DETAILED DESCRIPTION

FIGS. 1 through 19, discussed below, and the various embodiments used to describe the principles of the disclosure in this patent document are by way of illustration only and should not be construed in any way to limit the scope of the disclosure. Those skilled in the art will understand that the principles of the disclosure may be implemented in any suitably arranged system or device.

Hereinafter, embodiments of the disclosure will be described in detail with reference to the accompanying drawings.

First Embodiment

Figure 1:
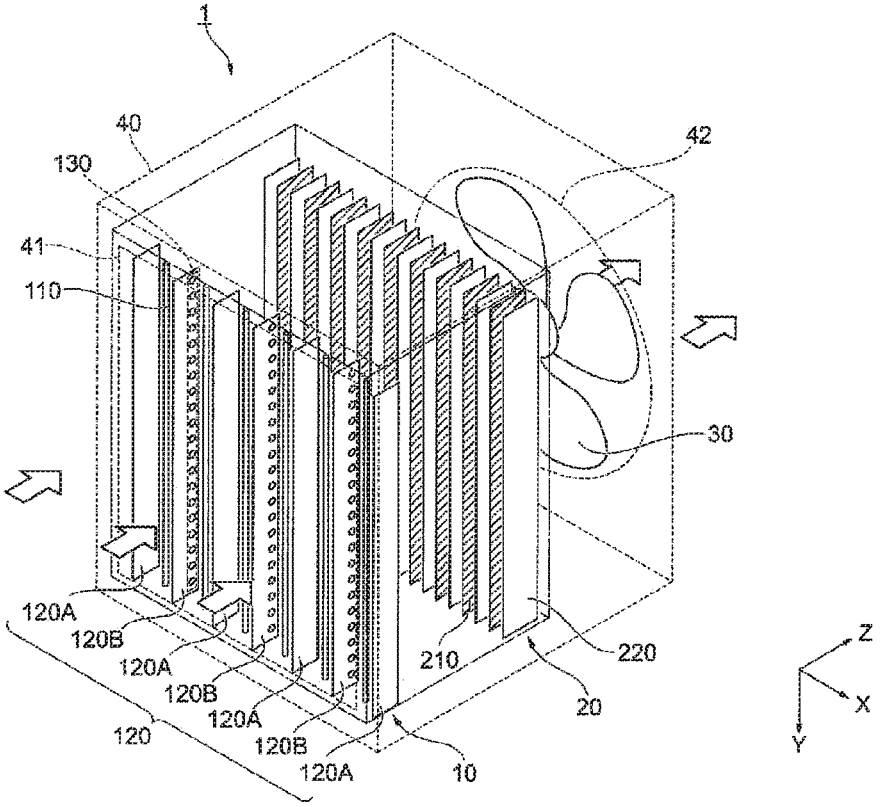
FIG. 1 illustrates a view of an example of a precipitator according to a first embodiment.

FIG. 1 illustrates a view of an example of a precipitator 1 according to a first embodiment.

The precipitator 1, to which the first embodiment is applied, includes a charger 10, a dust collector 20 and a fan 30, and a housing 40 accommodating the charger 10, the dust collector 20 and the fan 30. The housing 40 is shown by a broken line so that the configuration of the charger 10 and the dust collector 20 provided inside the housing 40 is shown. This precipitator 1 is a two-stage electrostatic dust collecting system in which functions of the charger 10 and the dust collector 20 are separated. The charger 10 and the dust collector 20 may be configured as a unit type that is detachable.

The precipitator 1 also includes a power supplier supplying a high voltage to the charger 10 and the dust collector 20, and a controller controlling the charger 10, the dust collector 20, the fan 30 and the power supplier, but a description thereof will be omitted. In addition, the charger 10 contained in the precipitator 1 to which a first embodiment is applied is an example of a charging apparatus.

As indicated by the arrow, the airflow (ventilation) direction (ventilation direction) is set in a direction toward the dust collector 20 from the charger 10 (the right side from the left side with respect to the ground of FIG. 1, and Z direction described later). The ventilation is performed by the fan 30 provided on the downstream side (leeward side) of the ventilation direction the dust collector 20.

(Charger 10)

The charger 10 is provided with a plurality of high voltage electrodes 110 and a plurality of counter electrodes 120 respectively facing the plurality of high voltage electrodes 110. The high voltage electrode 110 represents an electrode to which a high voltage is applied and thus is referred to as "high-voltage electrode". The high voltage electrode 110 is an electrode generating a discharge and thus referred to as "discharge electrode". Since there is a case in which the counter electrode 120 is grounded (GND), the counter electrode 120 may be referred to as "ground electrode".

The high voltage electrode 110 is formed of a wire-shaped member having conductivity.

The counter electrode 120 is formed of a plate-shaped member having conductivity. The counter electrode 120 is installed such that a plane of the plate-shaped member is along the ventilation direction. FIG. 1 illustrates that the plane of the counter electrode 120 is aligned with the ventilation direction (i.e., an angle between the plane of the counter electrode 120 and the ventilation direction is zero), but is not limited thereto. Therefore, it is appropriate that an angle between the plane of the counter electrode 120 and the ventilation direction is less than 90°.

The counter electrode 120 has a different shape with respect to a single sheet. That is, an even-numbered counter electrode 120 along the X direction has an opening 130, and an area of a portion functioning as the electrode (hereinafter referred to as "electrode area") is small, in comparison with an odd-numbered counter electrode 120. In other words, the counter electrodes 120 having different electrode areas are alternately arranged in the direction intersecting with the ventilation direction.

Hereinafter the charger 10 will be described as an example 1.

In the charger 10 of the example 1, an odd-numbered counter electrode 120 refers to a counter electrode 120A (in some cases referred to as "A") and an even-numbered counter electrode 120 refers to a counter electrode 120B (in some cases referred to as "B"). As for the counter electrode 120B, an opening 130 is configured by a through hole 131 which will be described later. Since the counter electrode 120B is provided with the through hole 131, the counter electrode 120B has the electrode area less than that of the counter electrode 120A.

The high voltage electrode 110 is indicated by "*". Accordingly, as for the precipitator 1 of FIG. 1, in the charger 10 of the example 1, the high voltage electrode 110 and the counter electrode 120 is arranged as A-*-B-*-A-*-B-*-A-*-B-*-A. An arrangement in which the counter electrode 120 having different electrode areas is alternately arranged is referred to as "alternate arrangement" and an arrangement in which the counter electrode 120 having the same electrode area is arranged is referred to as "homogeneous arrangement"

(Dust Collector 20)

The dust collector 20 is provided with a high voltage electrode 210 formed in a plate shape and coated with a film formed of an insulating material, and a counter electrode 220 formed in a plate shape having conductivity, wherein the high voltage electrode 210 and the counter electrode 220 are alternately stacked. In addition, it is appropriate that the counter electrode 220 has a shape capable of releasing the electric charge of the charged particles and the counter electrode 220 is coated with a resin film having the conductivity. A space between the high voltage electrode 210 and the counter electrode 220 becomes the ventilation direction. Meanwhile, since the counter electrode 220 is grounded (GND), the counter electrode 220 may be referred to as "ground electrode".

By the high voltage (not shown), a high voltage of direct current (DC) is applied between the high voltage electrode 210 and the counter electrode 220. The suspended particles charged in the charger 10 are attached to the surface of the counter electrode 220 by the static electricity. Thus, the suspended particles are collected.

The film formed of the insulating material covering the surface of the high-voltage electrode 210 may include polyethylene, polyethylene terephthalate (PET) and polytetrafluoroethylene (PTFE).

(Housing 40)

In the housing 40, an inlet 41 is installed in the side of the charger 10 in the upstream side (windward side) of the ventilation direction and an outlet 42 is installed in the side of the dust collector 20 in the leeward side. In addition, a mesh and a grid may be installed in the inlet 41. The mesh and grid installed in the inlet 41 may prevent a user from touching the charger 10 and reduce the resistance against the ventilation. In the inlet 41, a pre-filter may be installed to prevent a large-shaped particle from being introduced.

The fan 30 is installed in the outlet 42 installed in the housing 40 and disposed in the leeward side.

That is, the airflow (ventilation) enters the inlet 41 in the side of the charger 10 of the housing 40, passes through the charger 10 and the dust collector 20 and then comes out of the outlet 42 of the housing 40 in which the fan 30 is installed. For convenience of description, as illustrated in FIG. 1, the ventilation direction is set as a Z direction, and directions perpendicular to the Z direction are set as a X direction and a Y direction.

Further, as long as the ventilation is not blocked, the precipitator 1 may be placed in any direction.

For example, the housing 40 is formed of resin material such as acrylonitrile, butadiene, styrene copolymer (ABS).

By the high voltage (not shown), a high voltage of direct current (DC) is applied between the high voltage electrode 110 and the counter electrode 120. Accordingly, a corona discharge occurs between the high voltage electrode 110 and the counter electrode 120. Ions generated by the corona discharge adhere to the suspended particulates, thereby charging the suspended particulates.

Example 1

Figure 2A:
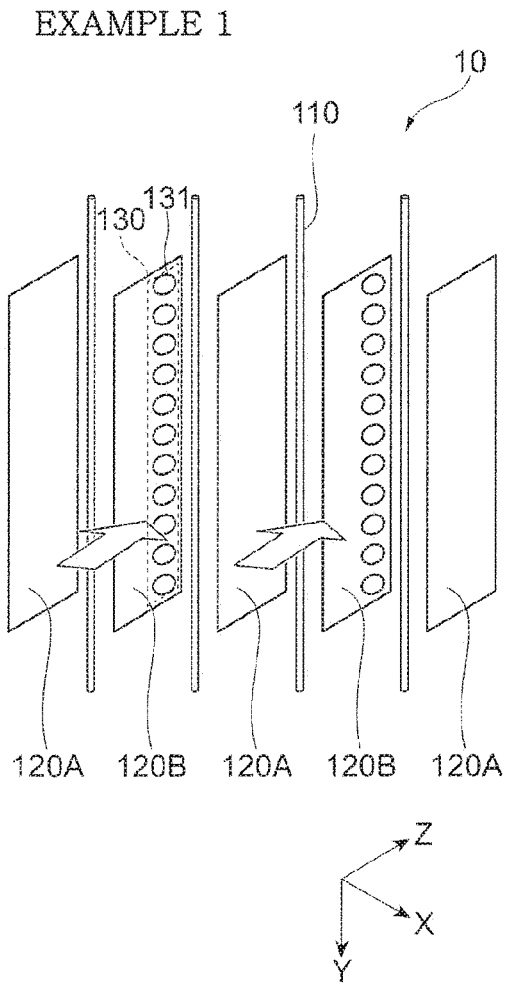
FIG. 2A illustrates a perspective view of a charger of an example 1.
Figure 2B:
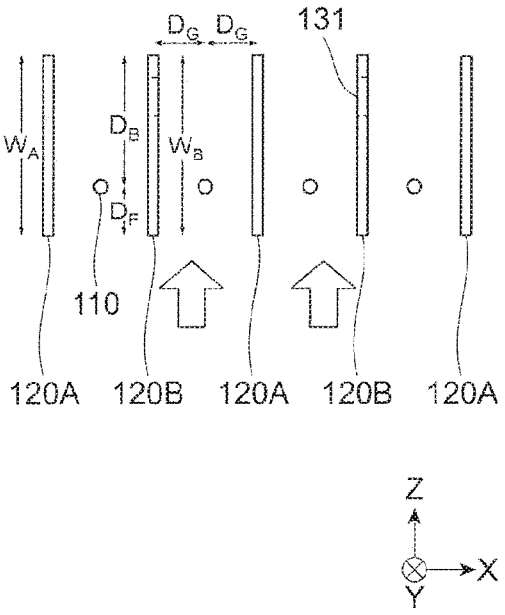
FIG. 2B illustrates a cross-sectional view (a cross-sectional view in the Y direction) of the charger of the example 1.
Figure 2C:
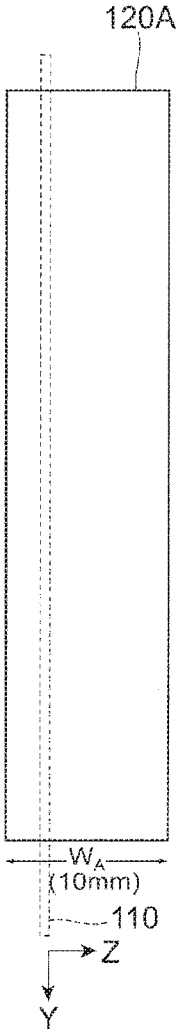
FIGS. 2C and 2D illustrate side views of the counter electrode of the example 1.
Figure 2D:
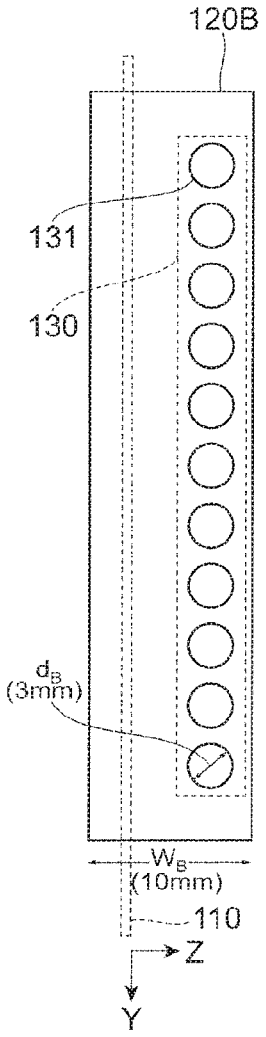

FIGS. 2A to 2D illustrate views of the charger 10 of the example 1 in details. FIG. 2A illustrates a perspective view of the charger 10 of the example 1, FIG. 2B illustrates a cross-sectional view (a cross-sectional view in the Y direction) of the charger 10, FIG. 2C illustrates a side view of the counter electrode 120A, and FIG. 2D illustrates a side view of the counter electrode 120B.

The charger 10 of the example 1 is provided with the high voltage electrode 110 and the counter electrodes 120A and 120B having different electrode areas.

As illustrated in FIGS. 2A and 2B, the high voltage electrode 110 is formed of a tungsten wire (W) having a diameter of 90 μm. That is, a cross section of the high voltage electrode 110 is a circle. In addition to tungsten, the high voltage electrode 110 may be a metal such as copper, nickel, stainless steel, zinc, iron, or an alloy containing the metal as a main component. In addition, the high voltage electrode 110 may be formed by plating a precious metal such as silver, gold, or platinum, on a surface of the metal or the alloy or the oxide containing the metal as a main component. In addition, if the high voltage electrode 110 is formed of a tungsten oxide, the high voltage electrode 110 may be stable. A diameter of the high voltage electrode 110 may be equal to or greater than 20 μm and equal to or less than 300 μm.

The counter electrode 120A has a plate shape without the opening 130. On the other hand, the counter electrode 120B has the opening 130 and the opening 130 is provided with the through hole 131. The counter electrode 120A without the through hole 131 and the counter electrode 120B having the through hole 131 are arranged (disposed) in the alternate arrangement. As mentioned above, the counter electrode 120A and the counter electrode 120B are arranged as A-*-B-*-A-*-B-*-A. This is simply indicated by "AB". Other examples will be described in the same manner.

In addition, the opening 130 refers to all of the through hole 131 on the counter electrode 120B. For convenience of description, FIGS. 1 and 2D illustrate the opening 130 surrounding the through hole 131.

For example, the counter electrode 120A and 120B is formed of aluminum. In addition to aluminum, the counter electrode 120 may be formed of metal such as stainless steel (SUS), and nickel alloy, or carbon.

For example, a width ($W_A$ and $W_B$) corresponding to a Z-direction length of the counter electrode 120A and 120B is 10 mm. Alternatively, the width ($W_A$ and $W_B$) may be less than 10 mm or greater than 10 mm. However, as the width ($W_A$ and $W_B$) is reduced, the size of the charger 10 may be reduced. A length (a Y-direction length) of the counter electrode 120 may be selected based on the size of the precipitator 1. For example, the length (a Y-direction length) is 400 mm.

As illustrated in FIG. 2C, the counter electrode 120A has a plate-shape without the opening 130. Meanwhile, as illustrated in FIG. 2D, the counter electrode 120B has the opening 130. A plurality of through holes 131 arranged in the Y direction is installed in a row in the opening 130. A plane shape of the through hole 131 is circular. For example, the through hole 131 has a diameter ($d_B$) of 3 mm (3 mm φ). In addition to the circle, the plane shape of the through hole 131 may have various shapes such as an oval or a quadrangle. The through hole 131 may have a shape preventing the electric field from being concentrated.

An outer shape of the counter electrode 120A and 120B is the same. Therefore, a ratio between an area of all of the through hole 131 (the opening 130) of the counter electrode 120 and the outer surface area of the counter electrode is indicated by an opening ratio or simply indicated by a ratio. That is, when the through hole 131 is not provided, the counter electrode 120A has an opening ratio (ratio) of 0%. On the other hand, the counter electrode 120B has an opening ratio (ratio) that is obtained by the area of the through hole 131. In the example 1, the counter electrode 120B has an opening ratio (ratio) of 13.8%.

As illustrated in FIG. 2B, the high voltage electrode 110 is installed in the windward side (−Z direction side) with respect to a width direction (Z direction) of the counter electrode 120. The high voltage electrode 110 is installed in a position, which is from an end portion of the windward side by a distance ($D_F$) and from an end portion of the leeward side by a distance ($D_B$), in the width direction of the counter electrode 120. In addition, $D_F+D_B=W_A$ or $W_B$. For example, $D_F:D_B$ is 3:7. However, the position of the high voltage electrode 110 is not limited thereto, and thus the high voltage electrode 110 may be installed in another position. As described above, a reason to install the high voltage electrode 110 out of the windward side of the high voltage electrode 110 with respect to the width direction of the counter electrode 120 will be described later.

For example, a distance ($D_G$) between the high voltage electrode 110 and the counter electrode 120A and 120B is 10 mm.

Comparative Example 1

Figure 3A:
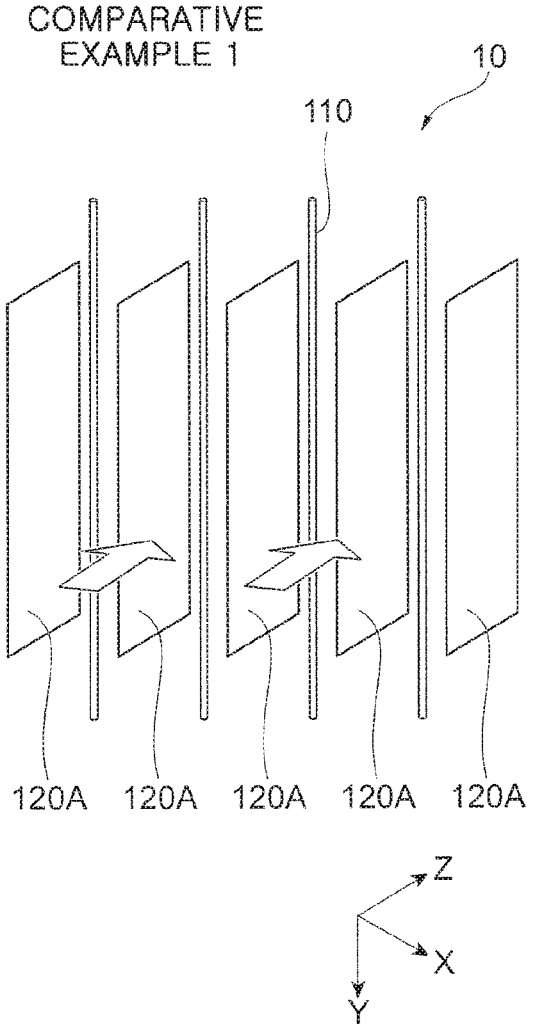
FIG. 3A illustrates a perspective view of a charger of a comparative example 1.
Figure 3B:
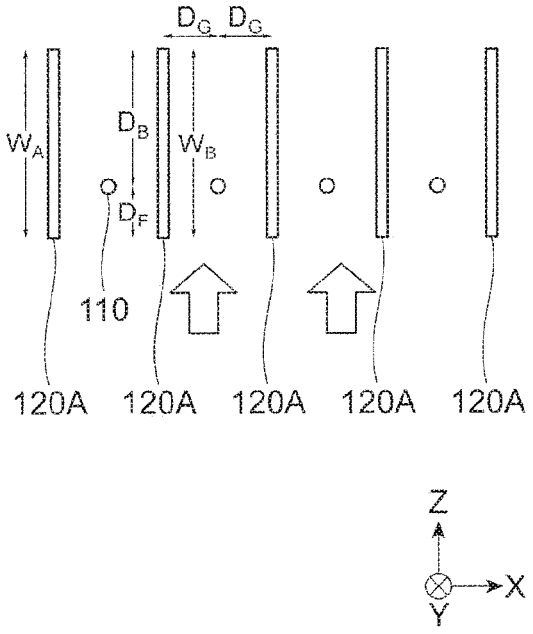
FIG. 3B illustrates a cross-sectional view (a cross-sectional view in the Y direction) of the charger of the comparative example 1.

FIGS. 3A and 3B illustrate views of a charger 10 of the comparative example 1. FIG. 3A illustrates a perspective view of the charger 10, and FIG. 3B illustrates a cross-sectional view (a cross-sectional view in the Y direction) of the charger 10. In the comparative example 1, all of the counter electrodes 120 correspond to the counter electrode 120A illustrated in FIG. 2C. That is, the charger 10 of the comparative example 1 illustrated in FIG. 3 A, corresponds to a configuration in which the counter electrode 120A ("A") is substituted for the counter electrode 120B ("B") of the example 2 of FIG. 2A. That is, the counter electrode 120 is arranged in the homogeneous arrangement of A-*-A-*-A-*-A-*-A. This is simply indicated by AA.

FIG. 4 is a table illustrating dust collection efficiency and an ozone concentration with the respective discharge currents in the example 1, the comparative example 1, other example and comparative example. The dust collection efficiency and the ozone concentration are measured with different discharge currents of the charger 10. The high voltage electrode 110 is formed of the tungsten wire having a diameter of 90 μm (circular cross section). A voltage between the high voltage electrode 210 and the counter electrode 220 of the dust collector 20 is 6 kV. Further, a wind speed of ventilation direction is set to 1 m/s. The discharge current is set to 150 μA, 250 μA and 450 μA.

The dust collection efficiency (%) is measured by counting the number of suspended particulates using a particle counter, before entering the upstream side (the charger 10) of the ventilation direction of the precipitator 1 and after discharging from the downstream side (the dust collector 20). In addition, the ozone concentration (ppb) is measured at the downstream side of the ventilation direction of the precipitator 1 (after discharging from the dust collector 20) by using an ozone meter.

As described above, as for the charger 10 of the example 1, the counter electrode 120 is arranged in the alternate arrangement (AB), and as for the comparative example 1, the counter electrode 120 is arranged in the homogeneous arrangement (AA).

In other examples 2 to 7, the counter electrode 120 of the charger 10 is arranged such that an example 2 is an AC type alternate arrangement, an example 3 is an AD type alternate arrangement, an example 4 is an AE type alternate arrangement, an example 5 is an AF type alternate arrangement, an example 6 is an AG type alternate arrangement, and an example 7 is an AH type alternate arrangement. That is, according to the examples 1 to 7, the counter electrode 120 has the alternate arrangement (disposition) having different shapes (different electrode areas).

Hereinafter a counter electrode 120C, 120D, 120E, 120F, 120G, and 120H in the examples 2 to 7 will be described.

Figure 5A:
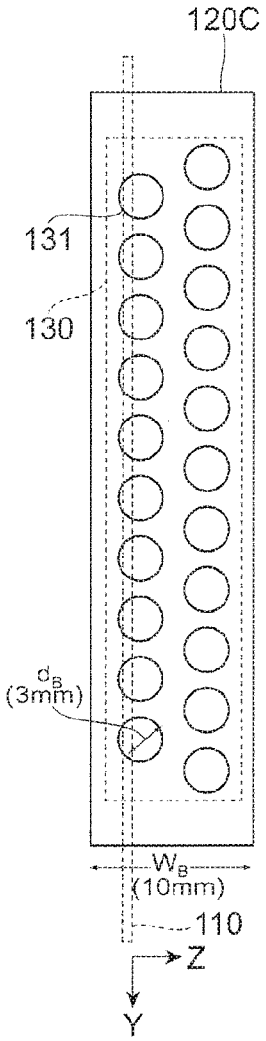
FIGS. 5A, 5B, 5C and 5D illustrate side views of different counter electrodes of another example.
Figure 5B:
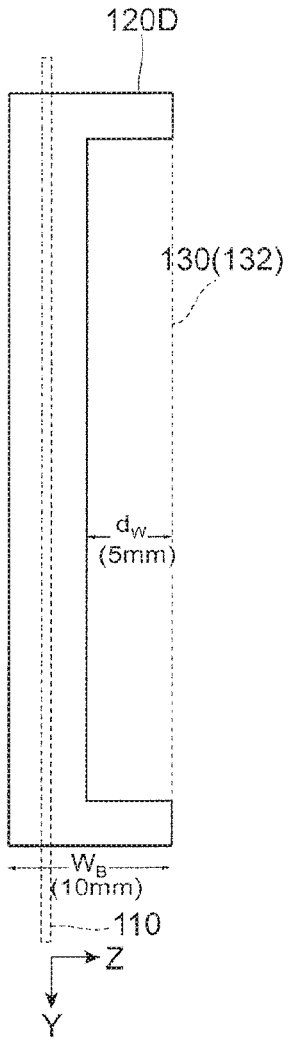
Figure 5C:
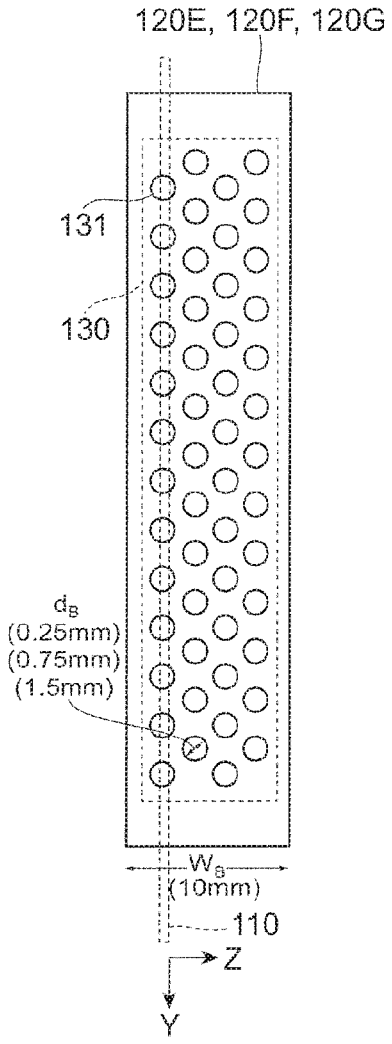
Figure 5D:
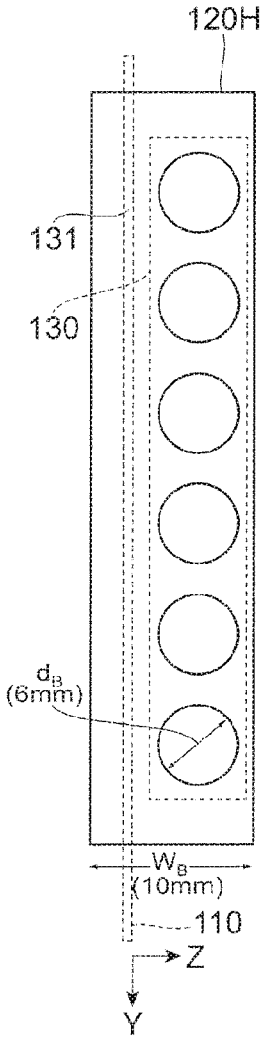

FIGS. 5A to 5D illustrate side views of other counter electrode 120C, 120D, 120E, 120F, 120G, and 120H. FIG. 5A illustrates the counter electrode 120C, FIG. 5B illustrates the counter electrode 120D, FIG. 5C illustrates the counter electrode 120E, 120F, and 120G, and FIG. 5D illustrates the counter electrode 120H.

In the counter electrode 120C illustrated in FIG. 5 A, the through hole 131 having a diameter of 3 mm (3 mmφ) is provided in two rows in a zigzag pattern in the Y direction. Therefore, the through hole 131 is provided on the entire surface of the counter electrode 120C. In this case, the opening ratio is 27.6%.

In the counter electrode 120D illustrated in FIG. 5 B, the counter electrode 120D is configured by a cut-out portion 132 installed in the leeward side (Z direction). That is, the counter electrode 120D is configured such that a part of the counter electrode 120A is cut-out. In other words, an end portion of the windward side of the counter electrode 120D is at the same position with respect to an end portion of the windward side of the counter electrode 120A and the Z direction (on the Z axis). An end portion of the leeward side of the counter electrode 120D is placed in a short position (a position with a small coordinate value) with respect to an end portion of the leeward side of the counter electrode 120D and the Z direction (on the Z axis).

A depth ($d_w$) of the cut-out portion 132 is set as 5 mm. Therefore, the opening ratio is 50%.

In addition, the counter electrode 120D may be formed by a metal having a width obtained by subtracting the depth ($d_w$) of the cut-out portion 132 from the width ($W_B$). That is, a width of the counter electrode 120D in the ventilation direction may be narrower than the width of the counter electrode 120A in the ventilation direction.

Further, the opening ratio is set by adjusting the depth ($d_w$).

In the counter electrode 120E, 120F, and 120G illustrated in FIG. 5C, a plurality of through-holes 131 having a diameter ($d_B$) is provided on the entire surface of the counter electrode 120 in the same as the counter electrode 120C of FIG. 5A. A through-hole 131 having a diameter ($d_B$) of 0.25 mm (0.25 mmφ) is installed in the counter electrode 120E. An opening ratio of the counter electrode 120E is 10%. A through-hole 131 having a diameter ($d_B$) of 0.75 mm (0.75 mmφ) is installed in the counter electrode 120F. An opening ratio of the counter electrode 120F is 36%. A through-hole 131 having a diameter ($d_B$) of 1.5 mm (1.5 mmφ) is installed in the counter electrode 120G. An opening ratio of the counter electrode 120G is 50%.

Further, in the counter electrode 120H illustrated in FIG. 5 D, a through-hole 131 having a diameter ($d_B$) of 6 mm (6 mmφ) is installed in the leeward side, in the same arrangement as the counter electrode 120B of FIGS. 2A and 2D.

In the other comparative examples 2 and 3 illustrated in FIG. 4, the counter electrode 120 of the charger 10 is configured such that the comparative example 2 is a BB type homogeneous arrangement and the comparative example 3 is a CC type homogeneous arrangement. That is, according to the comparative examples 1 to 3, the counter electrode 120 having the same shape (the same electrode area) is arranged in the homogeneous arrangement. In addition, the counter electrode 120B is illustrated in FIG. 2D and the counter electrode 120C is illustrated in FIG. 5A.

Figure 6A:
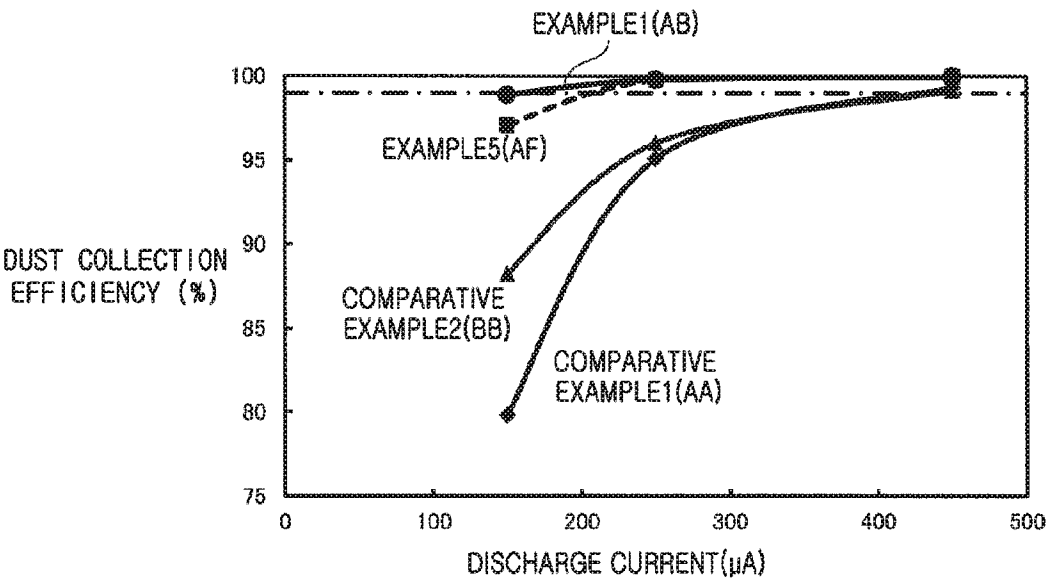
FIG. 6A is a graph illustrating discharge current dependency of the dust collection efficiency in the example 1, the example 5, and the comparative example 1 and the comparative example 2.
Figure 6B:
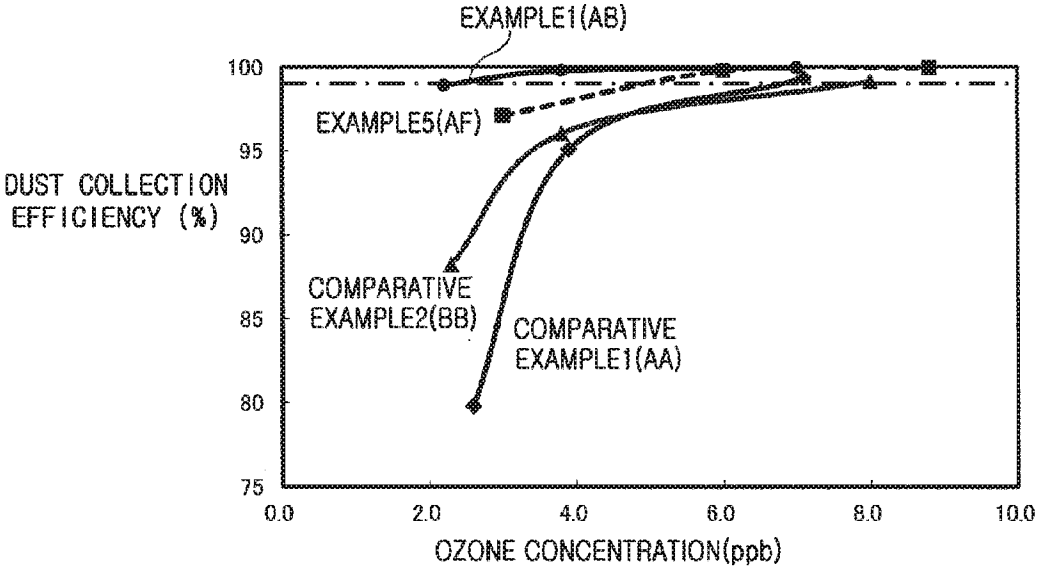
FIG. 6B is a graph illustrating a relationship between the dust collection efficiency and the ozone concentration in the example 1, the example 5, and the comparative example 1 and the comparative example 2.

Hereinafter prominent examples will be described based on the result of FIG. 4. FIG. 6A and FIG. 6B are graphs illustrating discharge current dependency of the dust collection efficiency, and a relationship between the dust collection efficiency and the ozone concentration in the example 1

(AB), the example 5 (AF), and the comparative example 1 (AA) and the comparative example 2 (BB). FIG. 6A illustrates discharge current dependency of the dust collection efficiency and FIG. 6B illustrates a relationship between the dust collection efficiency and the ozone concentration. In FIG. 6A, a horizontal axis represents a discharge current (μA), and a vertical axis represents dust collection efficiency (%). In FIG. 6 B, a horizontal axis represents an ozone concentration (ppb), and a vertical axis represents dust collection efficiency (%).

In the comparative example 1 (AA) of FIG. 6A, the dust collection efficiency is increased with the discharge current. However, if the discharge current is not 450 μA, the dust collection efficiency does not reach 99%.

In the comparative example 2 (BB), the dust collection efficiency is higher than the comparative example 1 (AA) with the discharge current at a low range. However, like the comparative example 1 (AA), if the discharge current is not 450 μA, the dust collection efficiency does not reach 99%.

That is, as illustrated in the comparative example 2 (BB), when the counter electrode 120B in which the opening 130 (the through hole 131) is installed in the leeward side, is arranged (disposed) in the homogeneous arrangement, the dust collection efficiency is more likely to be improved with the discharge current in the low range. However, the effect is small.

On the other hand, in the example 1 (AB) and example 5 (AF) in which the counter electrodes 120 having different opening ratio (ratio) are arranged (disposed) in the alternate arrangement, the dust collection efficiency is more likely to be improved with the discharge current in the low range, in comparison with the comparative example 1 (AA) and the comparative example 2 (BB). Particularly, in the example 1 (AB), although a discharge current is 150 μA, the dust collection efficiency of 98.88% is obtained.

Based on the example 1 (AB) and the comparative example 2 (BB), it is observed that the greater improvement of dust collection efficiency is not expected in the low range of 300 μA or less although the counter electrode 120B in which the opening 130 (the through hole 131) is installed in the leeward side, is arranged in the homogeneous arrangement, which is used in the example 1(AB). Based on the example 1 (AB) and the example 5 (AF) using the alternate arrangement, it is observed that the example 1 (AB) using the counter electrode 120B in which the opening 130 (the through hole 131) is installed in the leeward side, has an improved dust collection efficiency even at the low discharge current of 150 μA, in comparison with the example 5 (AF) in which the opening 130 (the through hole 131) is installed on the entire surface.

That is, it is observed that the dust collection efficiency is improved with the low range (150 μA) of the discharge current since the counter electrode 120B, in which the opening 130 (the through hole 131) is installed in the leeward side, and the counter electrode 120A without the opening 130 are arranged (disposed) in the charger 10 in the alternate arrangement. This represents that the charging efficiency of the suspended particulates is improved with the low range (150 μA) of the discharge current.

Based on the relationship between the dust collection efficiency and the ozone concentration illustrated in FIG. 6B, it is observed that the high dust collection efficiency is obtained while the ozone concentration is maintained at the low level according to the example 1(AB) and the example 5 (AF) having the alternate arrangement. This is because it is possible to obtain the high dust collection efficiency with the low discharge current in the example 1(AB) and the example 5 (AF), which is shown in the discharge current dependency of the dust collection efficiency illustrated in FIG. 6A. In contrast, as illustrated in the discharge current dependency of the dust collection efficiency illustrated in FIG. 6A, it is required to increase the discharge current to obtain the high dust collection efficiency and thus the ozone concentration is increased. That is, according to the example 1 (AB) and example 5 (AF), it is possible to obtain the dust collection efficiency of 95% or more, in a range in which the ozone concentration is 4.0 ppb or less, which is significantly lower than the environmental standard value (50 ppb).

Figure 7:
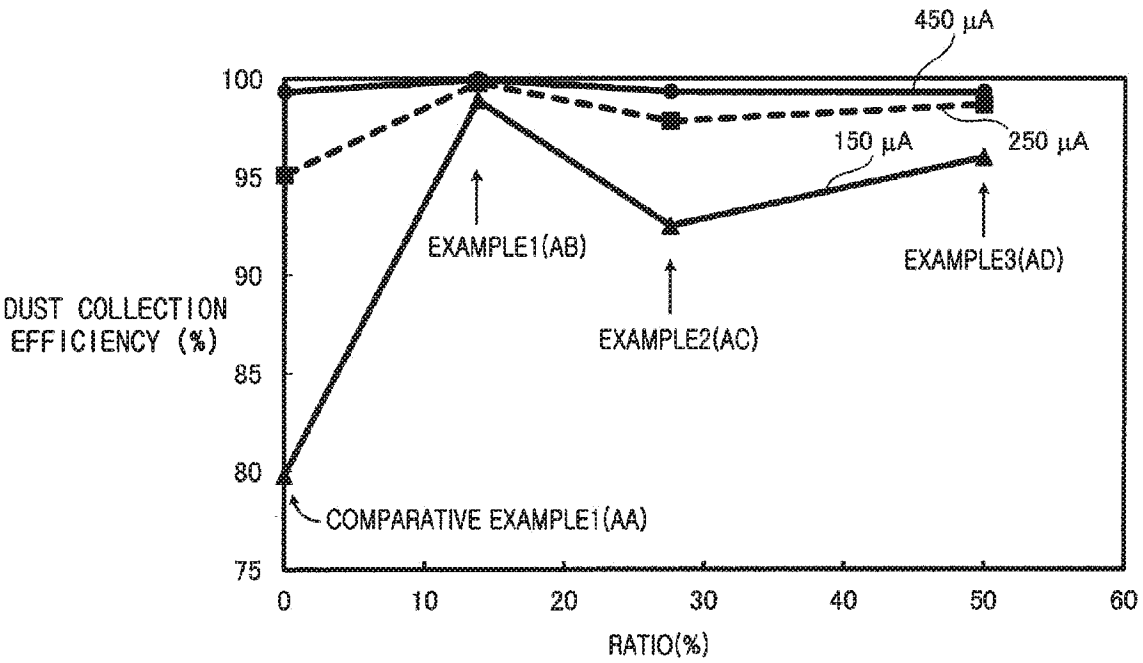
FIG. 7 is a graph illustrating a relationship between an opening ratio (ratio) and the dust collection efficiency with the respective discharge current in the examples 1, 2, and 3, in which a counter electrode having an opening is arranged (disposed) in an alternate arrangement, and a comparative example 1.

FIG. 7 is a graph illustrating a relationship between an opening ratio (ratio) and the dust collection efficiency with the respective discharge current in the examples 1, 2, and 3, in which a counter electrode having the opening 130 is arranged (disposed) in an alternate arrangement, and the comparative example 1. A horizontal axis represents a ratio (%) and a vertical axis represents dust collection efficiency (%). The discharge current is set as 150 μA, 250 μA, and 450 μA.

The comparative example 1 (AA) has a ratio of 0%. The counter electrode 120B of the example 1 (AB) is provided such that the through hole 131 of 3 mmφ is provided in the opening 130 in the leeward side, and its ratio is 13.8%. The counter electrode 120C of the example 2 (AC) is provided such that the through hole 131 of 3 mmφ is provided on the entire surface, and its ratio is 27.6%. The counter electrode 120D of the example 3 (AD) is provided with the cut-out portion 132 on the leeward side, and its ratio is 50%.

As illustrated in FIG. 7, it is observed that the example 1 (AB), the example 2 (AC) and the example 3 (AD) in which the counter electrode 120 having the opening 130 is arranged (disposed) in the alternate arrangement, has the high dust collection efficiency with the low discharge current (e.g., 150 μA), in comparison with the comparative example 1 (AA) without the opening 130. In this respect, when the opening ratio (ratio) is 10% or more and 50% or less, the dust collection efficiency is improved with the low discharge current (e.g., 150 μA). However, based on a fact that the example 1 (AB) having the ratio of 13.8% and the example 3 (AD) having the ratio of 50% have the high dust collection efficiency with the low discharge current, in comparison with the example 2 (AC) having the ratio of 27.6%, it is observed that the dust collection efficiency is not always improved although the opening ratio (ratio) is increased. It is observed that it is appropriate that the opening 130 (the through hole 131) or the cut-out portion 132 is installed in the leeward side. As for the opening 130, when a ratio of the through hole 131 per unit area is referred to as "opening degree", it is observed that an opening degree of the leeward side is higher than an opening degree of the windward side. That is, the through hole 131 may be installed such that the opening degree is increased from the windward side to the leeward side. For example, the through hole 131 may be provided such that the diameter ($d_B$) is increased from the windward side to the leeward side with a predetermined interval or the number of the through hole 131 is increased from the windward side to the leeward side.

In addition, as for the counter electrode 120D in which the opening 130 having a narrow width caused by the cut-out portion 132, a distance between an end portion in the windward side of the counter electrode 120D and an end portion in the windward side of the counter electrode 120A may be less than a distance between an end portion in the leeward side of the counter electrode 120D and an end portion in the leeward side of the counter electrode 120A.

Figure 8:
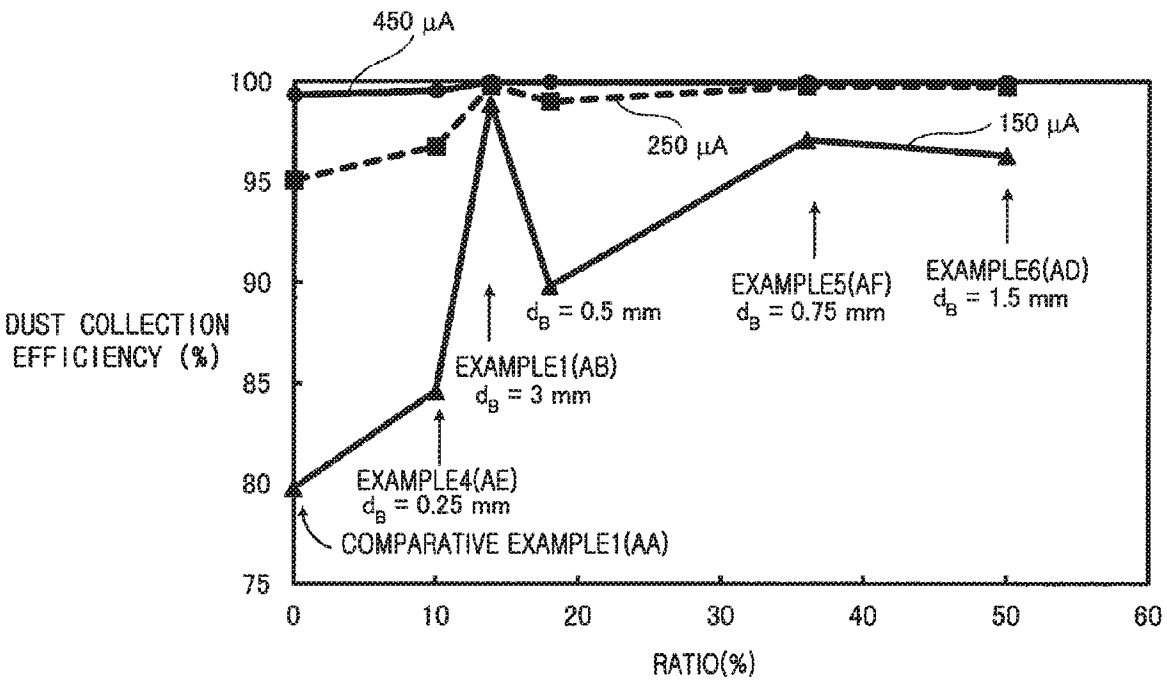
FIG. 8 is a graph illustrating a relationship between an opening ratio (ratio) and the dust collection efficiency with the respective discharge current in the examples 1, 4, 5 and 6 in which a counter electrode having an opening including through holes having different diameters, is arranged (disposed) in an alternate arrangement and the comparative example 1.

FIG. 8 is a graph illustrating a relationship between an opening ratio (ratio) and the dust collection efficiency with the respective discharge current in the examples 1, 4, 5 and 6 in which the counter electrode having the opening including through holes having different diameters ($d_B$), is arranged (disposed) in the alternate arrangement, and in the comparative example 1. A horizontal axis represents a ratio (%) and a vertical axis represents dust collection efficiency (%). The discharge current is set as 150 μA, 250 μA, and 450 μA.

The comparative example 1 (AA) does not have the through hole 131 and thus its ratio is 0%. The counter electrode 120E of example 4 (AE) is provided such that the through hole 131 having a diameter ($d_B$) of 0.25 mm is disposed on the inner surface, and its ratio is 10%. The counter electrode 120B of example 1 (AB) is provided such that the through hole 131 having a diameter ($d_B$) of 3 mm is provided in the leeward side, and its ratio is 13.8%. An example indicating a ratio of 18%, which is not shown in FIG. 4, is provided such that the through hole 131 having a diameter ($d_B$) of 0.5 mm is disposed on the enter surface. The counter electrode 120F of example 5 (AF) is provided such that the through hole 131 having a diameter ($d_B$) of 0.75 mm is disposed on the enter surface, and its ratio is 36%. The counter electrode 120D of example 6 (AD) is provided such that the through hole 131 having a diameter ($d_B$) of 1.5 mm is disposed on the enter surface, and its ratio is 50%. The example 1 (AB), the example 4 (AE), the example 5 (AF), the example 6 (AD) and a case having the ratio of 18% have the alternate arrangement.

At the high discharge current (450 μA), it does not show that there is a significant difference caused by the diameter ($d_B$) of the through hole 131. However, at the low discharge current (150 μA, and 250 μA), the dust collection efficiency is improved, as the diameter ($d_B$) of the through hole 131 is increased. However, the example 1 (AB) in which the through hole 131 of 3 mmφ is provided in the leeward side, has the highest dust collection efficiency.

It is observed that there is an improvement in the dust collection efficiency of the example 1 (AB), the example 4 (AE), the example 5 (AF), the example 6 (AD) and a case having the ratio of 18%, in comparison with the comparative example 1 (AA). Based on this result and a result of the example 7, it is observed that the diameter ($d_B$) of the through hole 131 of the opening 130 indicating the improved dust collection efficiency is equal to or greater than 2.5% and equal to or less than 60% with respect to the width ($W_B$) of the ventilation direction of the counter electrode 120. In addition, the opening ratio making the improvement of the dust collection efficiency is equal to or greater than 10% and equal to or less than 50%.

Therefore, in the case of the counter electrode 120D in which the opening 130 is provided with the cut-out portion 132, the depth ($d_w$) of the cut-out portion 132 may be 10% or more and 50% or less of the width ($W_B$) of the counter electrode 120D. That is, the ratio of the electrode area of the counter electrode 120D with respect to the counter electrode 120A may be set to more than 50% and less than 90%.

Hereinbefore the case in which the counter electrode 120 in which the opening 130 is disposed in the leeward side, is arranged (disposed) in the alternate arrangement, such as the example 1 (AB), the example 3 (AD), and the example 7 (AH), and the case in which the counter electrode 120 in which the opening 130 is disposed on the entire surface, is arranged (disposed) in the alternate arrangement, such as the example 2 (AC), the example 4 (AE), the example 5(AF) and the example 6 (AG), have been described.

Hereinafter a case in which the counter electrode 120 in which the opening 130 is disposed in the windward side, is arranged (disposed) in the alternate arrangement, will be described.

FIG. 9 is a table illustrating dust collection efficiency and an ozone concentration with the respective discharge current of a precipitator having the counter electrode of the charger 10, and the charger 10 in the comparative example 1 and comparative examples 4 and 5. As described above, the comparative example 1 is that the counter electrode 120 is arranged in the AA type homogeneous arrangement. Meanwhile, a comparative example 4 is an AB' type alternate arrangement, and a comparative example 5 is an AD' type alternate arrangement. The discharge current is set as 150 μA, 250 μA, and 450 μA.

Hereinafter a counter electrode 120B' and 120D' of the comparative examples 4 and 5 will be described.

Figure 10A:
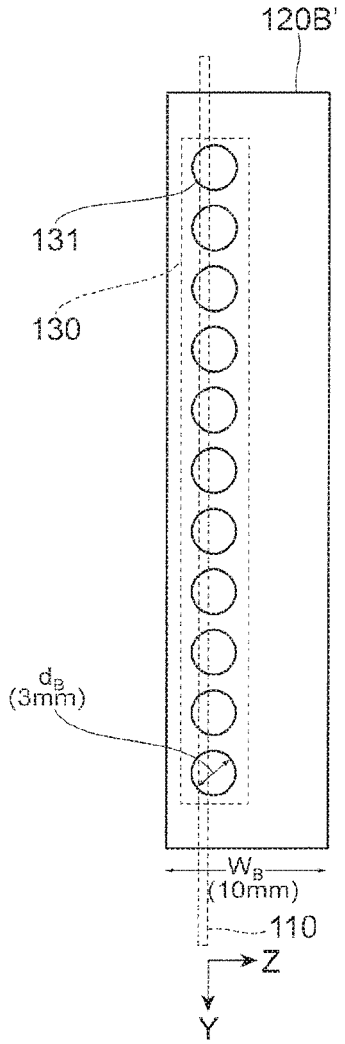
FIG. 10A illustrates a side view of a counter electrode in the comparative example 4.
Figure 10B:
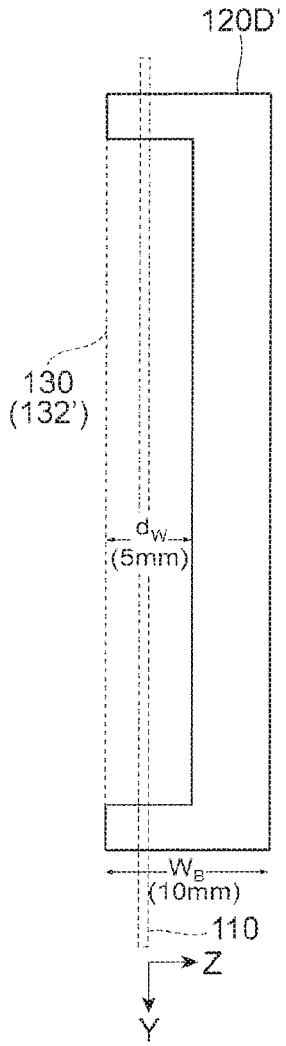
FIG. 10B illustrates a side view of a counter electrode in the comparative example 5.

FIG. 10A and FIG. 10B are side views illustrating the counter electrode 120B' and 120D' of the comparative examples 4 and 5. FIG. 10A illustrates the counter electrode 120B' according to the comparative example 4, and FIG. 10B illustrates the counter electrode 120D' according to the comparative example 5.

The counter electrode 120B' of FIG. 10A is provided such that the through hole 131 having a diameter ($d_B$) of 3 mm (3 mm φ) is arranged in the Y direction in a row in the leeward side. That is, the counter electrode 120B' has a configuration in which the windward side and the leeward side of the counter electrode 120D illustrated in FIG. 2D are switched to each other. In this case, its ratio is 13.8%.

The counter electrode 120D' of FIG. 10B is provided such that the opening 130 is configured by a cut-out portion 132' installed in the leeward side. That is, the counter electrode 120D' has a configuration in which the windward side and the leeward side of the counter electrode 120D illustrated in FIG. 5D are switched to each other. In this case, its ratio is 50%.

In addition, the opening ratio of the comparative example 1 (AA) is 0%.

Figure 11:
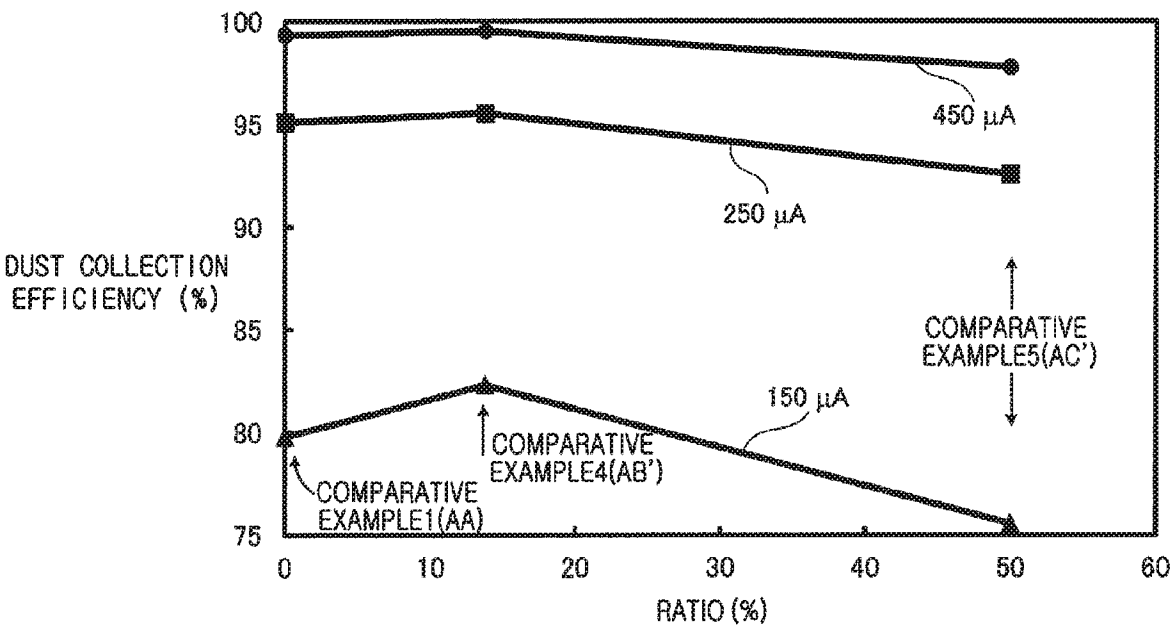
FIG. 11 is a graph illustrating a relationship between an opening ratio (ratio) and the dust collection efficiency with the respective discharge current in the comparative examples 4 and 5 in which a counter electrode in which an opening is disposed in a upstream, is disposed in an alternate arrangement and the comparative example 1.

FIG. 11 is a graph illustrating a relationship between an opening ratio (ratio) and the dust collection efficiency with the respective discharge current in the comparative examples 4 (AB') and 5 (AD') in which the counter electrode in which the opening is arranged (disposed) in an upstream, is disposed in the alternate arrangement and in the comparative example 1 (AA). A horizontal axis represents a ratio (%) and a vertical axis represents dust collection efficiency (%). The discharge current is set as 150 μA, 250 μA, and 450 μA.

In FIG. 11, it is observed that it does not follow the discharge current and the improvement of the dust collection efficiency does not occur, although the opening 130 (the through hole 131) and the cut-out portion 132 are installed in the windward side as illustrated in the comparative example 4 (AB') and the comparative example 5 (AD'), in comparison with the comparative example 1 without the opening 130. This is because the counter electrode 120 is not present at a portion facing the high voltage electrode 110 and the electric field is hardly applied to the portion.

That is, it can be seen that it is appropriate to provide the opening 130 on the leeward side. It is appropriate that the center of gravity of the through hole 131 is located on the leeward side of the high voltage electrode 110 when the opening 130 is configured by the through hole 131. The center of gravity of the through hole 131 refers to not a hole of the through hole 131, but the center of gravity of the plate-shaped member. When the plane shape of the through hole 131 is a circle, the center of gravity of the through hole 131 becomes the center of the through hole 131.

(Measurement of Ion Number)

It is considered that the improvement of the dust collection efficiency at the low discharge current (such as 150 μA) is due to an increase in the number of generated ions (the number of ions) at the low discharge current. That is, it is considered that the improvement of the dust collection efficiency is due to an increase in the number of generated ions, and thus the number of suspended particles, to which ions are attached, is increased and the dust collection efficiency is improved.

In order to confirm this, the number of generated ions (the number of ions) generated from the charger 10 is measured in the example 1 (AB), the example 3 (AD) and the comparative example 1 (AA). In the example 1 (AB) and the example 3 (AD), the counter electrode 120 in which the opening 130 is disposed on the leeward side, is arranged in the alternate arrangement. The comparative example 1 (AA) is a case in which the counter electrode 120 without the opening 130 is arranged in the homogeneous arrangement.

The number of ions generated from the charger 10 is measured under a condition that the dust collector 20 is not provided in the precipitator 1. The number of ions generated in the charger 10 is measured by an ion counter provided at a position 30 cm in the leeward side from the charger 10 at a wind speed of 1 m/sec.

Figure 12:
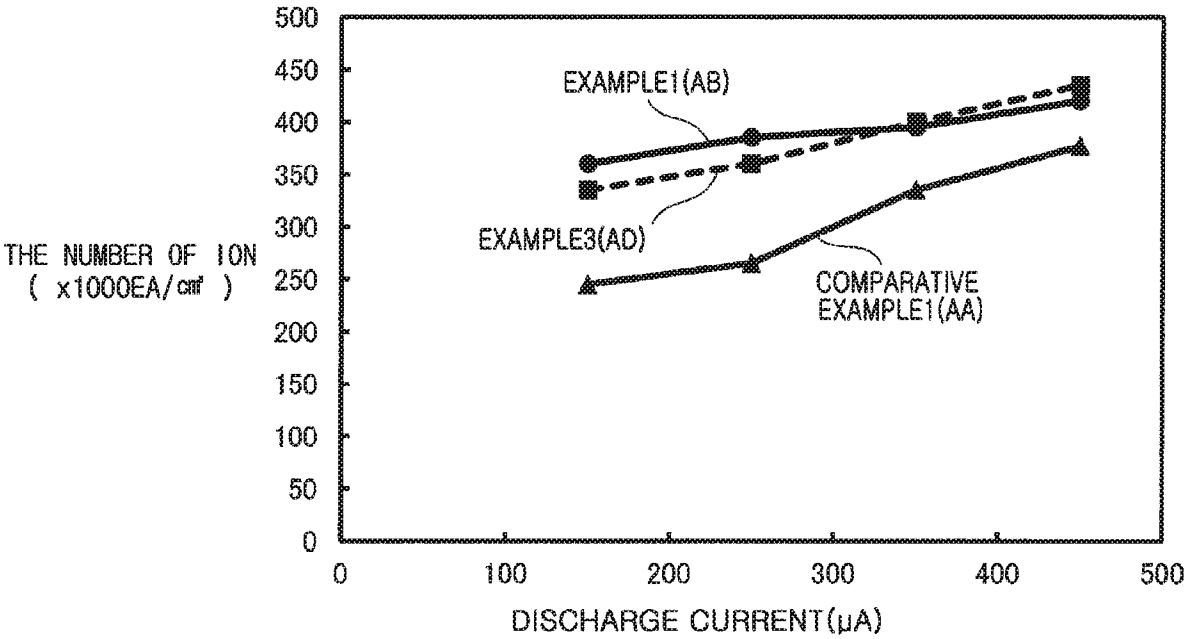
FIG. 12 is a graph illustrating a relationship measured number of ions and the discharge current in the charger in the examples 1, and 3 and the comparative example 1.

FIG. 12 is a graph illustrating a relationship between the measured number of ions and the discharge current in the charger 10 in the example 1 (AB), the example 3 (AD) and the comparative example 1 (AA). A horizontal axis represents a discharge current (μA) and a vertical axis represents the number of ions (×1000 ions/cm 3). The ion number of the vertical axis is an average value of measured number of ions obtained by performing sampling every 10 seconds for 10 minutes at the discharge currents of 150 μA, 250 μA, 350 μA and 450 μA.

In FIG. 12, it is observed that the number of ions in the example 1 (AB) and the example 3 (AD) is greater regardless of the discharge current level, in comparison with the comparative example 1 (AA). Particularly, the difference in the number of ions is large at the low discharge current (150 μA, and 250 μA).

Accordingly, it can be seen that the number of ions increases by arranging the counter electrodes 120, in which the opening 130 is arranged on the leeward side, in the alternate arrangement.

The ions are generated in a discharge space in the extreme vicinity of the high voltage electrode 110. The ions move downstream along the ventilation. At this time, the ions adhere to the suspended particulates, and the suspended particulates are charged. Therefore, as the number of ions is increased, the number of charged suspended particulates is also increased. As the number of charged suspended particulates increases, the dust collection efficiency is improved.

In the example 1 (AB), the example 3 (AD) and the comparative example 1 (AA), the high voltage electrode 110 has the same configuration. That is, the high voltage electrode 110 is a tungsten wire having a diameter of 90 μm. In the example 1 (AB) and the example 3 (AD), the opening 130 is provided in the leeward side. That is, the portion of the counter electrode 120 that is not the opening 130 is opposed to the vicinity of the high voltage electrode 110. The distance ($D_G$) between the high voltage electrode 110 and the counter electrode 120 is also equal to 10 mm. Accordingly, it is considered that there is no difference in the discharge volume of the discharge generated in the extreme vicinity of the high voltage electrode 110 in the example 1 (AB), the example 3 (AD) and the comparative example 1 (AA). That is, it is considered that there is no difference in the number of generated ions.

However, as illustrated in FIG. 12, the number of ions measured on the leeward side is different in the example 1 (AB), the example 3 (AD) and the comparative example 1 (AA). Accordingly, it is considered that some of the ions generated in the high voltage electrode 110 disappear before reaching the dust collector 20. That is, it is considered that the ions are electrostatically attracted and then attached to or collided with the counter electrode 120 and thus electric charge is lost (neutralized).

The number of ions measured on the leeward side is large in the example 1 (AB) and the example 3 (AD), in which the opening 130 is provided in the leeward side. Therefore, it is considered that the probability that the ions adhere to or collide with the counter electrode 120 is reduced by the opening 130 formed on the leeward side of the counter electrode 120.

As illustrated in the example 2 (AC), the example 4 (AE), the example 5 (AF), and the example 6 (AG), when the counter electrode 120 is arranged in the alternate arrangement although the counter electrode 120, in which the opening 130 is installed on the entire surface, is used, the dust collection efficiency is improved, in comparison with the comparative example 1.

However, despite using the counter electrode 120 provided with the opening 130 as in the comparative example 2 (BB) and the comparative example 3 (CC), the improvement of the dust collection efficiency is not observed when the counter electrode 120 is arranged in the homogeneous arrangement. In this respect, it is difficult for the ions to disappear (neutralize) by arranging the counter electrode 120 having the opening 130 and the counter electrode 120 without the opening 130 in the alternate arrangement. That is, it is considered that the electric field generated between the neighboring counter electrodes 120 prevents the loss (neutralization) of the ion.

Further, as a time (residence time) in which ions are present in the charger 10, is longer, the probability of charging the suspended particles is increased. Therefore, it is appropriate to dispose the high voltage electrode 110 on the windward side including the center of the counter electrode 120. Conversely, when the high voltage electrode 110 is shifted to the windward side from an end portion of the windward side of the counter electrode 120, the electric field strength in the vicinity of the high voltage electrode 110 is lowered, which is not appropriate.

In addition, it is also considered that when the counter electrode 120 having the opening 130 is used, the reason for the increase in the number of ions is that turbulence of the air flow is generated, and the residence time of the ions is increased. However, according to the simulation, the turbulence of the airflow is not recognized at a flow rate of 1 m/sec.

Particularly, at the low discharge current, the number of generated ions is small. However, by suppressing the disappearance (neutralization) of ions having a small number of generated particles, the charging efficiency of the suspended particulates may be improved, and the dust collection efficiency may be increased even at the low discharging current. By lowering the discharge current, the ozone concentration can be suppressed to a low level. That is, it is possible to simultaneously obtain the high dust collection efficiency and the suppression of the ozone concentration.

Second Embodiment

In the first embodiment, it is to provide the improvement in the dust collection efficiency at the low discharge current by suppressing the loss (neutralization) of ions generated in the discharge space around the high voltage electrode 110, by using the configuration of the counter electrode 120.

In the second embodiment, it is to provide a configuration of a high voltage electrode 110 that improves the dust collection efficiency at the low discharge current in which ozone occurs less.

Figure 13:
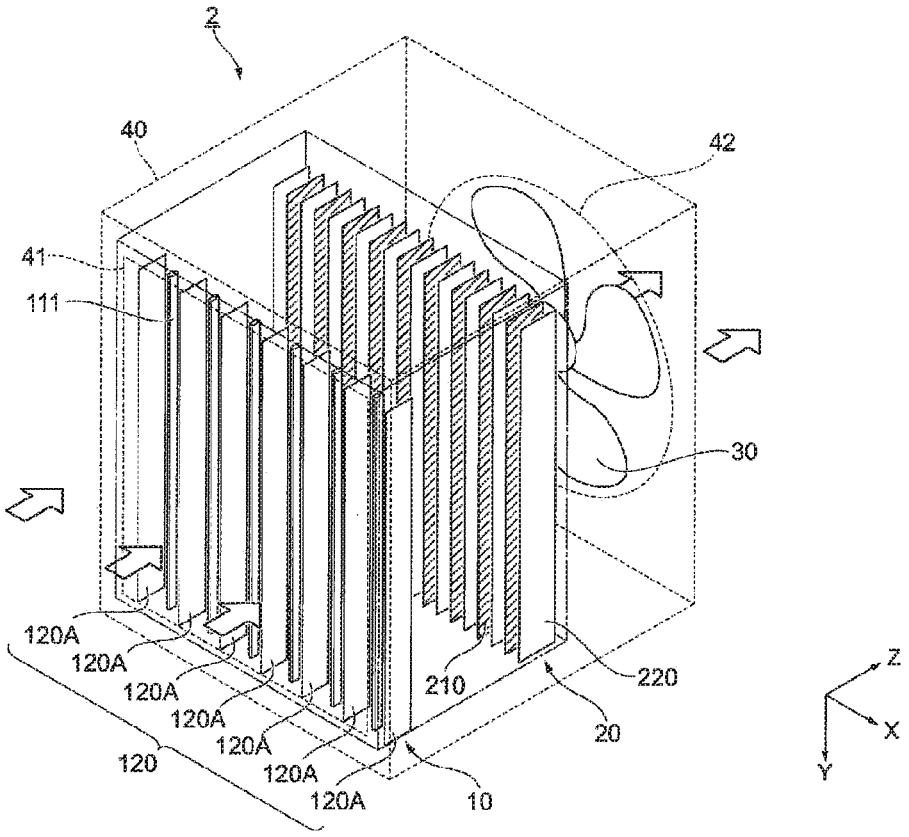
FIG. 13 illustrates a view of an example of a precipitator according to a second embodiment.

FIG. 13 illustrates an example of a precipitator 2 according to the second embodiment.

The precipitator 2 to which the second embodiment is applied has a charger 10, a dust collector 20, a fan 30, and a housing 40 accommodating the charger 10, the dust collector 20, and the fan 30. Except for the charger 10, the precipitator 2 is the same as the precipitator 1 to which the first embodiment is applied, and therefore, the same reference numerals designate and the description is omitted. The charger 10 provided in the precipitator 2 to which the second embodiment is applied is another example of the charging apparatus.

(Charger 10)

The charger 10 includes a plurality of high voltage electrodes 110 and a plurality of counter electrodes 120 respectively facing the plurality of high voltage electrodes 110.

The high voltage electrode 111 is formed of a wire-shaped member having conductivity. Further, the high voltage electrode 111 has a cross section in which a rectangular corner portion has an arc shape. This cross-sectional shape is indicated by an oval or racing track shape.

The counter electrode 120 is formed of a plate-shaped member having conductivity. The counter electrode 120 is installed such that a plane of the plate-shaped member is along the ventilation direction. In addition, the counter electrodes 120 having the same shape (same electrode area) are arranged (disposed) in the homogeneous arrangement. In FIG. 13, the counter electrode 120 is the counter electrode 120A illustrated in FIG. 2C. The counter electrode 120A is not provided with the opening 130.

Example 8

Figure 14A:
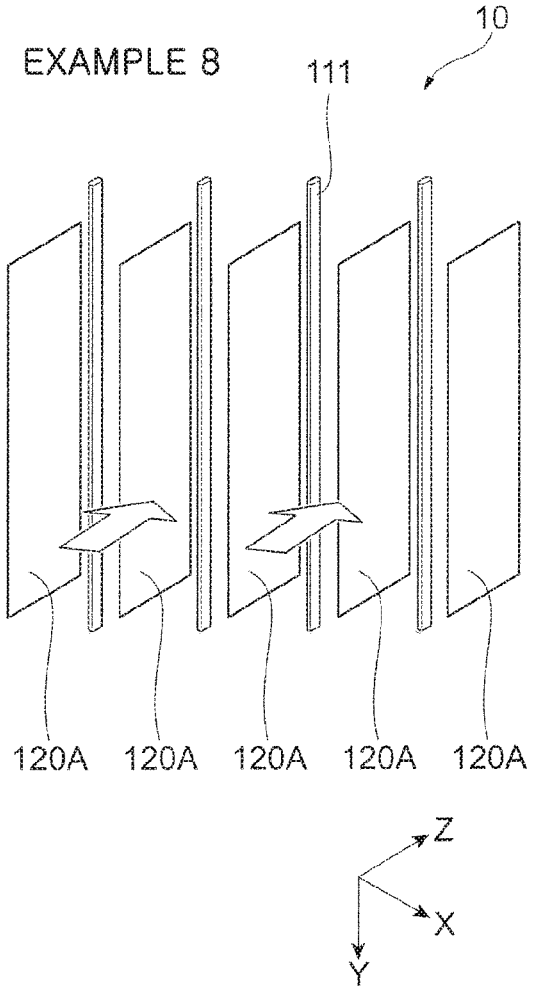
FIG. 14A illustrates a perspective view of a charger of an example 8.
Figure 14B:
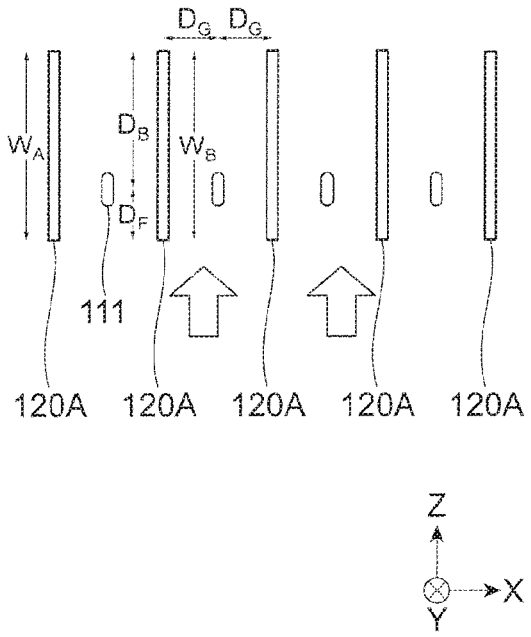
FIG. 14B illustrates a cross-sectional view (a cross-sectional view in the Y direction) of the charger of the example 8.
Figure 14C:
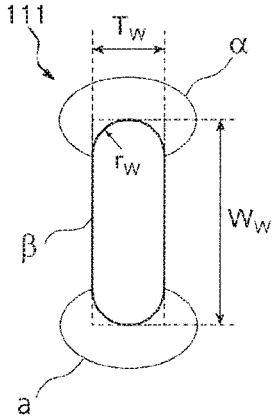
FIG. 14C illustrates a cross-sectional view of a high electrode of the example 8.

FIGS. 14A to 14C illustrate views of a charger 10 of an example 8. FIG. 14A is a perspective view of the charger 10, FIG. 14B is a cross-sectional view (a cross-sectional view in the Y direction) of the charger 10, and FIG. 14C is a cross-sectional view of a high electrode 111 of the example 8.

As illustrated in FIG. 14C, an oval-shaped cross section of the high voltage electrode 111 is provided such that a corner of a square has an arc shape having a radius of curvature ($r_w$). A longitudinal direction of the rectangle is defined as a length of a long side ($W_W$) and a short direction is defined as a length of a short side ($T_W$).

As shown in FIGS. 14A and 14B, the high voltage electrode 111 is disposed such that the longitudinal direction of the rectangle is disposed in a direction parallel to the surface of the counter electrode 120A. Alternatively, the longitudinal direction of the rectangle of the high voltage electrode 111 may be perpendicular to the surface of the counter electrode 120A.

The corona discharge occurs at a portion where the electric field is high. The volume of this portion is referred to as a discharge volume. As for the high voltage electrode 110 in a wire shape having a circular cross section (refer to FIG. 2B), as a diameter is reduced, the electric field around the high voltage electrode 110 becomes higher and the discharge volume becomes smaller. Since the electric field is high, the number of generated ions increases, but the generation of ozone is suppressed because the discharge volume is small.

However, when the diameter ($d_B$) of the high voltage electrode 110 is made small, that is, when it is made thinner, it is difficult to handle the high voltage electrode 110. For example, it is difficult to mount the high voltage electrode 110 formed of a tungsten (W) to a predetermined portion. When the high voltage electrode 110 formed of tungsten (W) is bent, it is difficult to change the shape and the discharge characteristics are uneven. In addition, the high voltage electrode 110 formed of a tungsten (W) is also easy to bend.

As illustrated in FIG. 14C, in the high voltage electrode 111 having an oval cross section, the corona discharge occurs in a portion (α) in which a curvature radius ($r_w$) of the cross section is small. In a portion (β) which is a center portion in the longitudinal direction of the rectangle, the corona discharge is unlikely to occur. Therefore, by decreasing a curvature radius ($r_w$) of a corner of the cross section, the discharge volume may be reduced, and the generation of ozone may be suppressed while increasing the number of generated ions.

The high voltage electrode 111 in the charger 10 of the example 8 has a curvature radius ($r_w$) of the corner of the cross section that is ½ of the length of the short side ($T_W$). In the high voltage electrode 111, the length of the long side ($W_W$) is 150 μm, and the length of the short side ($T_W$) is 50 μm. Accordingly, it is similar with a case, in which the high-voltage electrode 110 having the diameter having a circular cross section is divided into two, and a space therebetween is opened. That is, it is similar that the high voltage electrode 110 having a diameter of 90 μm as described in the first embodiment is changed into a diameter of 50 μm. When using the above-mentioned cross-sectional shape, it is difficult to bend or snap and thus it is easy to handle.

FIG. 15 is a table illustrating dust collection efficiency and an ozone concentration with the respective discharge currents of a precipitator having the high electrode 110 and 111 and the counter electrode 120 of the charger 10 and the charger 10 in the example 8, the comparative example 1, another example and other comparative examples.

The comparative example 1 has been described in the first embodiment. Example 9 and comparative examples 6 and 7 will be described later. The discharge current is set as 15 μA, 250 μA, and 450 μA.

Figure 16A:
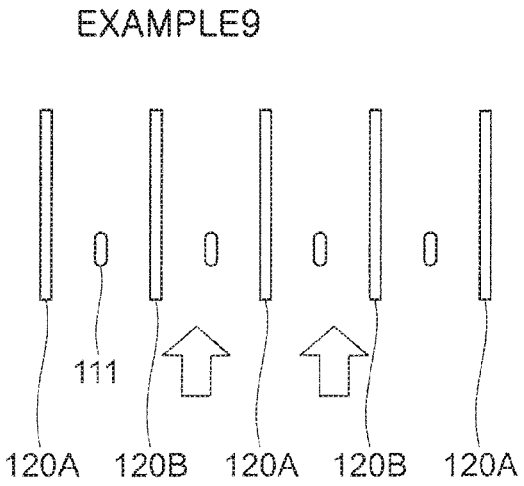
FIG. 16A illustrates a view of a charger of an example 9.
Figure 16B:
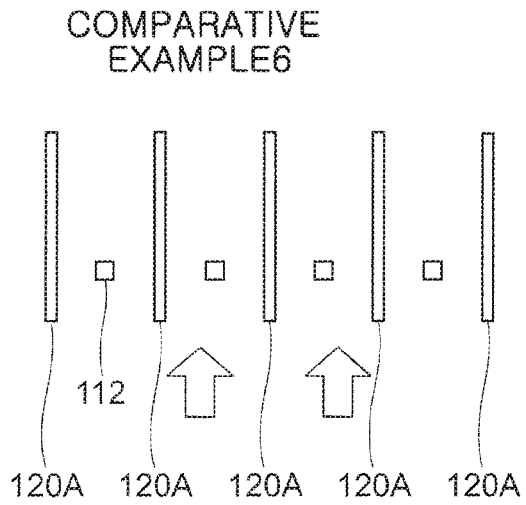
FIG. 16B illustrates a view of a charger of a comparative example 6.
Figure 16C:
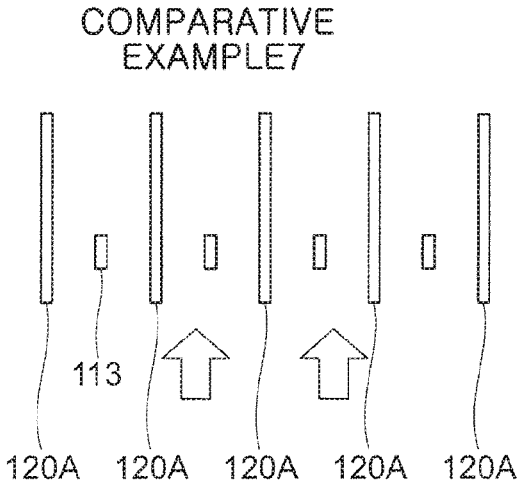
FIG. 16C illustrates a view of a charger of a comparative example 7.

FIGS. 16A to 16C are views illustrating a charger 10 of the example 9, and the comparative examples 6 and 7. FIG. 16A is the example 9, FIG. 16B is the comparative example 6, and FIG. 16C is the comparative example 7.

The example 9 is a combination of the oval shaped-high voltage electrode 111 shown in the example 8, and the counter electrodes 120A and 120B arranged in the alternate arrangement shown in the example 1 of the first embodiment.

The comparative example 6 uses a high voltage electrode 112 having a square cross section, instead of the high voltage electrode 111 of the example 8. The high voltage electrode 112 having the square cross section is formed of stainless steel (SUS), and one side is 70 μm. The comparative example 7 uses a high voltage electrode 113 having a rectangular cross section, instead of the high voltage electrode 111 of the example 8. The high voltage electrode 113 having the rectangular cross section is formed of stainless steel (SUS), and a length in the longitudinal direction is 150 μm, and a length of the short direction is 50 μm. The high voltage electrode 113 is disposed such that the longitudinal direction is disposed parallel to the surface of the counter electrode 120A. In the comparative examples 6 and 7, the counter electrodes 120A without the opening 130 are arranged in the homogeneous arrangement.

Figure 17A:
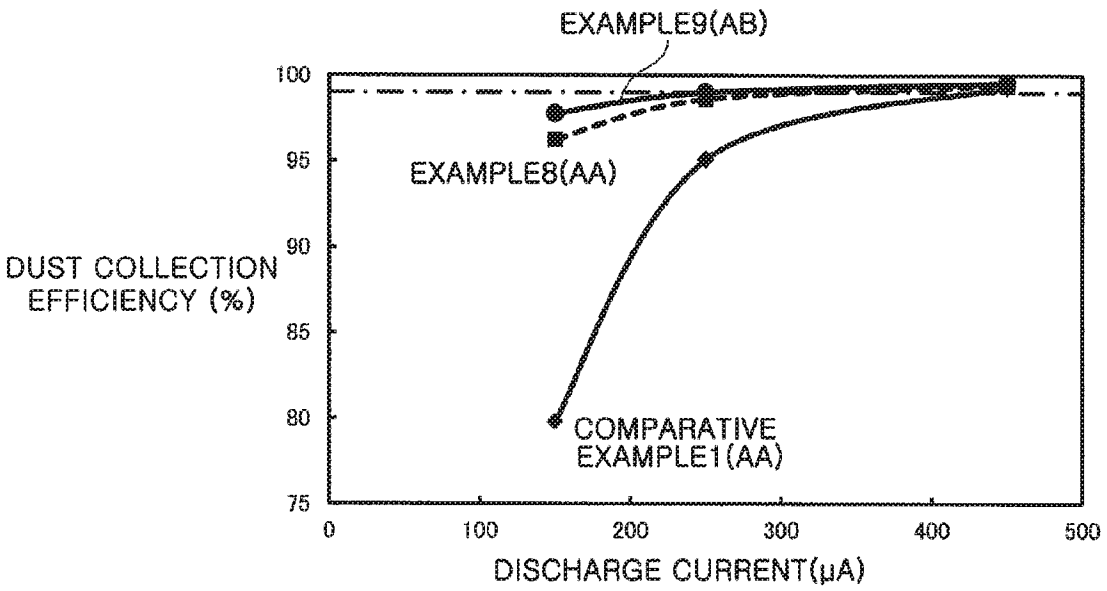
FIG. 17A is a graph illustrating discharge current dependency of the dust collection efficiency in the example 8, the example 9, and the comparative example 1.
Figure 17B:
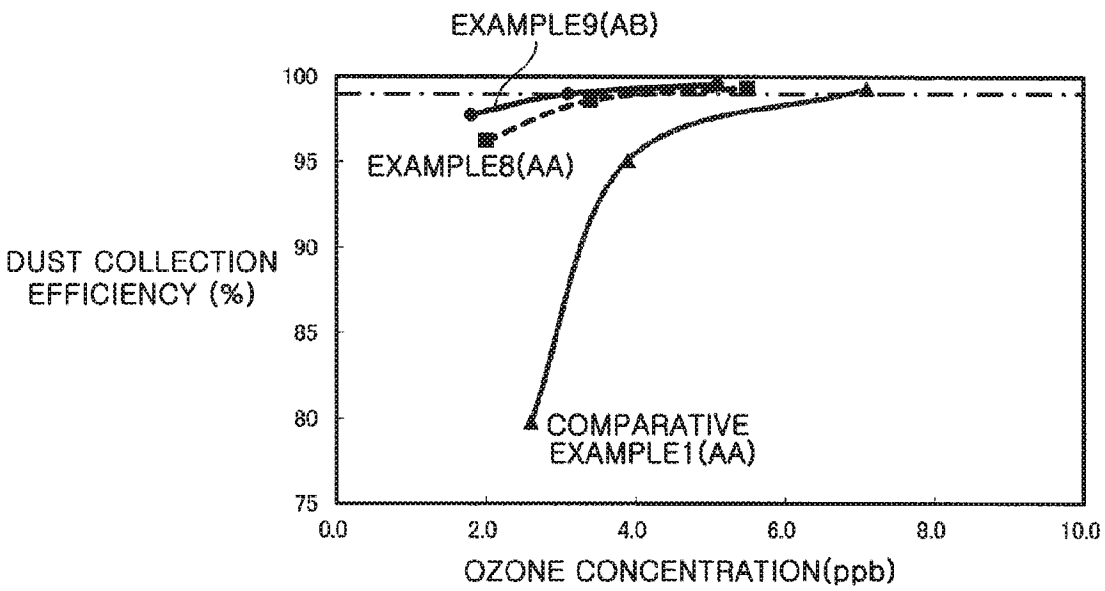
FIG. 17B is a graph illustrating a relationship between the dust collection efficiency and the ozone concentration in the example 8, the example 9, and the comparative example 1.

FIGS. 17A and 17B are graphs illustrating discharge current dependency of the dust collection efficiency, and a relationship between the dust collection efficiency and the ozone concentration in the example 8 (AA), the example 9 (AB), and the comparative example 1 (AA). FIG. 17A illustrates the discharge current dependency of the dust collection efficiency, and FIG. 17B illustrates a relationship between the dust collection efficiency and the ozone concentration. In FIG. 17A, a horizontal axis represents a discharge current (μA), and a vertical axis represents dust collection efficiency (%). In FIG. 17 B, a horizontal axis represents an ozone concentration (ppb), and a vertical axis represents dust collection efficiency (%).

In FIG. 17A, in the comparative example 1 (AA), the dust collection efficiency increases with the discharge current. However, if the discharge current is not 450 μA, the dust collection efficiency does not reach 99%.

On the other hand, in the example 8 (AA) using the high-voltage electrode 111 having a racing track shape, the dust collection efficiency is improved even at the low range of the discharge current (150 μA and 250 μA), in comparison with the comparative example 1 (AA). That is, it can be seen that the amount of generated ions is increased by the high voltage electrode 111 having the racing track shape.

In the example 9 (AB) using both the high voltage electrode 111 having the racing track shape and the counter electrodes 120A and 120B arranged in the alternate arrangement, the dust collection efficiency is further improved in the low range of the discharge current.

Based on the relation between the collection efficiency and the concentration of ozone as illustrated in FIG. 17B, it can be seen that it is possible to suppress the ozone concentration to be low while maintaining the high collection efficiency, according to the examples 8 (AA) and 9 (AB) configured to obtain the high collection efficiency with the low discharge current.

Figure 18A:
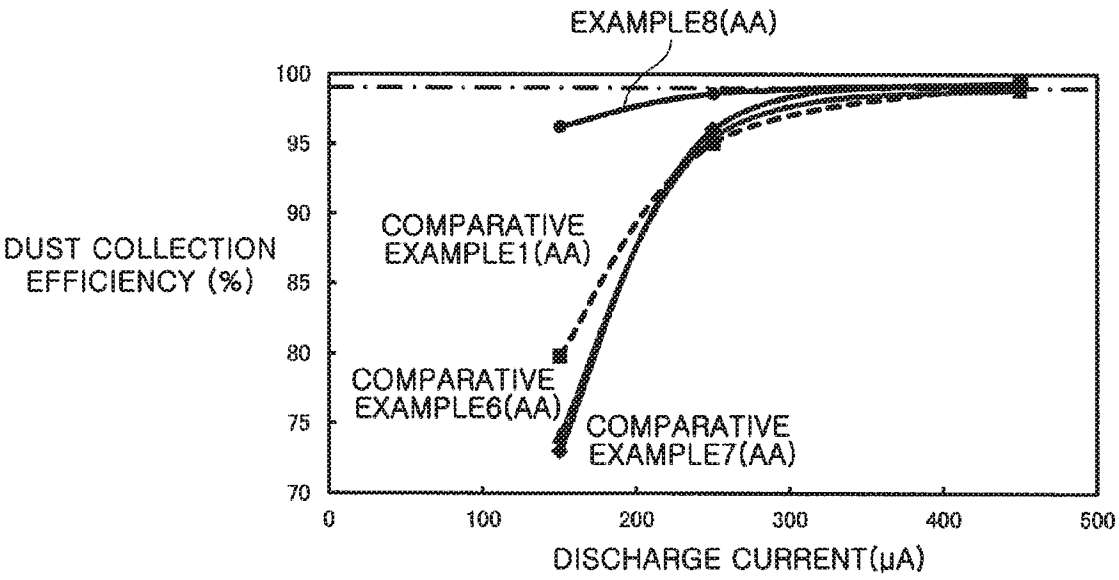
FIG. 18A is a graph illustrating discharge current dependency of the dust collection efficiency in the example 8, the comparative example 1, the comparative example 6 and the comparative example 7.
Figure 18B:
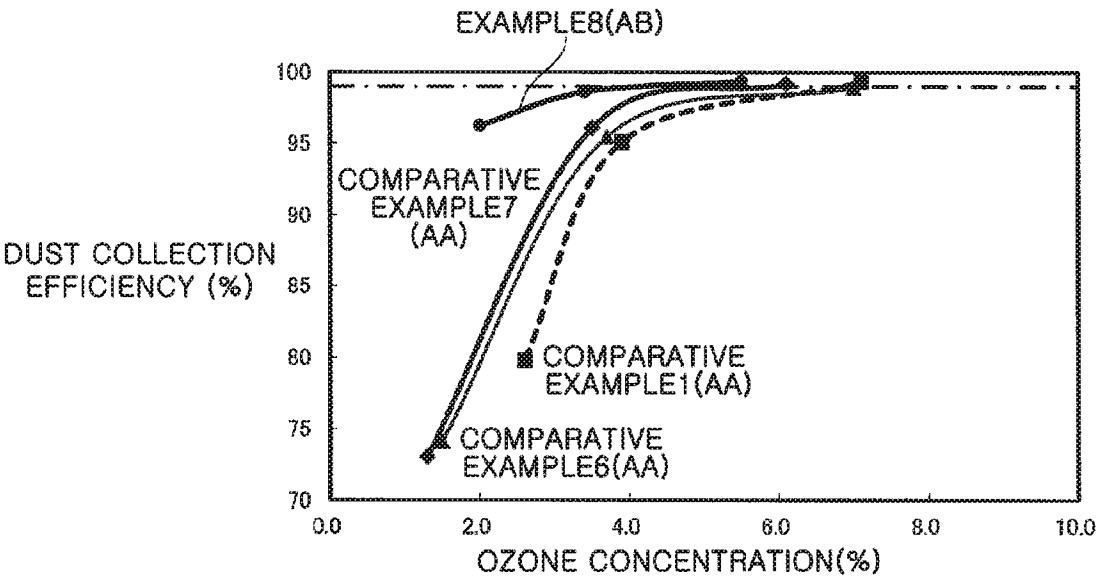
FIG. 18B is a graph illustrating a relationship between the dust collection efficiency and the ozone concentration in the example 8, the comparative example 1, the comparative example 6 and the comparative example 7.

FIGS. 18A and 18B are graphs illustrating discharge current dependency of the dust collection efficiency, and a relationship between the dust collection efficiency and the ozone concentration in the example 8 (AA), the comparative example 1 (AA), the comparative example 6 (AA) and the comparative example 7 (AA). FIG. 18A illustrates the discharge current dependency of the dust collection efficiency, and FIG. 18B illustrates a relationship between the dust collection efficiency and the ozone concentration. In FIGS. 18 A and 18B, a horizontal axis and a vertical axis are the same as FIGS. 17 A and 17B.

In FIG. 18A, in the comparative example 6 (AA) using the high voltage electrode 112 having a square cross section, and the comparative example 7 (AA) using the high voltage electrode 111 having a rectangular cross section, the dust collection efficiency is low even at the low range of the discharge current (150 μA and 250 μA), in comparison with the comparative example 1 (AA). In addition, based on the relationship between the dust collection efficiency and the ozone concentration as illustrated in FIG. 18B, it can be seen that the amount of generated ions is increased upon trying to obtain the high collection efficiency according to the comparative examples 6 (AA) and 7(AA).

As described above, it is appropriate that the oval-shaped corner of the high voltage electrode 111 has the arc shape and its angle is not 90°. That is, as for the oval-shaped corner of the high voltage electrode 111 having the arc shape, it is appropriate that the arc shape has a curvature radius ($r_w$) equal to or greater 5% and equal to or less than 50% (½) of the length of the short side ($T_W$). For example, the length of the short side ($T_W$) is 50 μm to 100 μm and the length of the long side ($W_W$) is 0.6 mm to 1.0 mm. It is appropriate that the length of the long side ($W_W$) is greater than 1 and less than 4 with respect to the length of the short side ($T_W$). If the length of the short side ($T_W$) can be made smaller (thinner), it becomes the same as using the thin high-voltage electrode 110 having a circular cross section. Further, if the length of the long side ($W_W$) exceeds 4 with respect to the length of the short side ($T_W$), it is difficult to process by using a wire-shaped member.

The high voltage electrode 111 may be formed of the same material as the high voltage electrode 110 described in the first embodiment.

Based on the relation between the collection efficiency and the concentration of ozone as illustrated in FIG. 17B, it can be seen that it is possible to suppress the ozone concentration to be low while maintaining the high collection efficiency, according to the examples 8 (AA) and 9 (AB) configured to obtain the high collection efficiency with the low discharge current.

Third Embodiment

The precipitator 1, to which the first embodiment is applied, and the precipitator 2, to which the second embodiment is applied, are provided with the dust collector 20 using the static electricity by using the high voltage electrode 210 and the counter electrode 220.

A precipitator 3 to which a third embodiment is applied, uses a dust collection filter.

Figure 19:
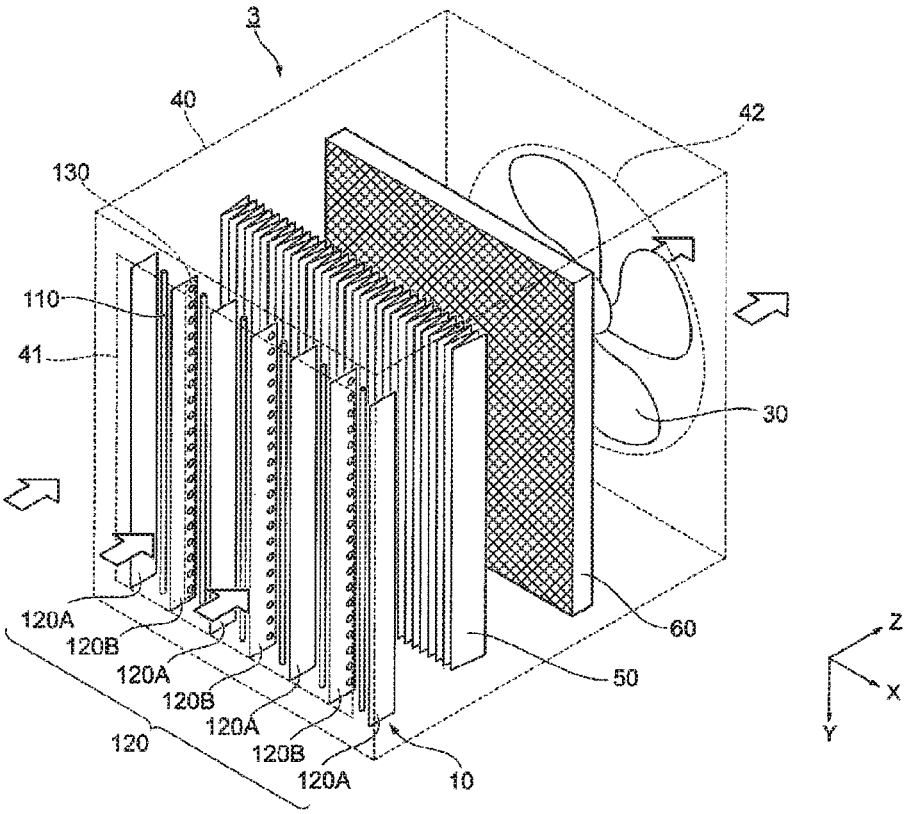
FIG. 19 illustrates a view of an example of a precipitator according to a third embodiment.

FIG. 19 illustrates an example of a precipitator 3 according to a third embodiment.

The precipitator 3 to which the third embodiment is applied has a charger 10, a dust collection filter 50, a deodorizing filter 60, a fan 30, and a housing 40 accommodating the charger 10, the dust collection filter 50, the deodorizing filter 60, and the fan 30. The dust collector 20 of the precipitator 1, to which the first embodiment illustrated in FIG. 1 is applied, is replaced with the dust collection filter 50. The deodorizing filter 60 may be appropriately provided on the front face (upstream side) or the back face (downstream side) of the charger 10, and the rear face (downstream side) of the dust collection filter 50.

The charger 10 may be the same as the charger 10 shown in the embodiment in the precipitator 1 to which the first embodiment is applied and the precipitator 2 to which the second embodiment is applied.

Since the dust collection filter 50 is a fiber filter and is electret-processed, the suspended particles charged by the charger 10 are likely to be adsorbed. Further, it is appropriate that the dust collection filter 50 has a large surface area by bending (pleat processing).

Numerical values shown in the examples 1 to 9 are merely examples, and thus it is not limited to these numerical values.

As is apparent from the above description, according to the charging apparatus and precipitator, it is possible to improve charging efficiency of suspended particles while suppressing an ozone concentration that is generated.

Although a few embodiments of the present disclosure have been shown and described, it would be appreciated by those skilled in the art that changes may be made in these embodiments without departing from the principles and spirit of the disclosure, the scope of which is defined in the claims and their equivalents.

Although the present disclosure has been described with various embodiments, various changes and modifications may be suggested to one skilled in the art. It is intended that the present disclosure encompass such changes and modifications as fall within the scope of the appended claims.

What is claimed is:

1. A charging apparatus comprising:

a plurality of counter electrodes formed in a plate shape and arranged in a direction intersecting with a ventilation direction to allow respective surfaces thereof to follow the ventilation direction; and a plurality of high voltage electrodes formed in a wire shape and installed between the plurality of counter electrodes, wherein the plurality of counter electrodes comprises:

a first counter electrode having a first electrode area, and a second counter electrode having a second electrode area less than the first electrode area, wherein the first counter electrode and the second counter electrode are alternately arranged, and wherein the second counter electrode comprises a plurality of through holes.

2. The charging apparatus of claim 1, wherein the second counter electrode is configured such that an opening degree is higher in a leeward side than a windward side.

3. The charging apparatus of claim 1, wherein the second counter electrode is configured such that a center of gravity of each of the plurality of through holes is placed closer to a leeward side than a high voltage electrode.

4. The charging apparatus of claim 1, wherein the second counter electrode is formed in a plate shape such that a width thereof in the ventilation direction is narrower than a width in the ventilation direction of the first counter electrode.

5. The charging apparatus of claim 4, wherein the second counter electrode is disposed such that a distance between an end portion of a windward side of the second counter electrode and an end portion of the windward side of the first counter electrode is less than a distance between an end portion of a leeward side of the second counter electrode and the leeward side of the first counter electrode.

6. The charging apparatus of claim 1, wherein a ratio of the second electrode area to the first electrode area is between 50% and 90%.

7. The charging apparatus of claim 1, wherein when a plane shape of each of the plurality of through holes is a circle, a diameter is in a range of 2.5% to 60% of a width for the second counter electrode in the ventilation direction.

8. The charging apparatus of claim 1, wherein a high voltage electrode, from among the plurality of high voltage electrodes, is disposed on a center of the ventilation direction of the first counter electrode or on a windward side of the first counter electrode.

9. The charging apparatus of claim 1, wherein a high voltage electrode, from among the plurality of high voltage electrodes, has a circular cross section having a diameter in a range of 20 μm to 300 μm.

10. The charging apparatus of claim 1, wherein a high voltage electrode, from among the plurality of high voltage electrodes, comprises a cross section in which a corner of a rectangle has an arc shape.

11. The charging apparatus of claim 10, wherein the high voltage electrode having the arc shaped corner having a curvature radius that is in a range of 5% to 50% of a length for a short side of the cross section.

12. The charging apparatus of claim 10, wherein the high voltage electrode is configured such that a short side of the cross section is in a range of 50 μm to 100 μm.

13. The charging apparatus of claim 10, wherein the high voltage electrode is configured such that a ratio of a length of a long side thereof with respect to a length of a short side exceeds 1 and equal to or less than 4.

14. The charging apparatus of claim 1, wherein a high voltage electrode, from among the plurality of high voltage electrodes, comprises:

one of:

a metal having any one of tungsten, copper, nickel, stainless steel, zinc, and iron, an oxide containing the metal as a main component, or an alloy containing the metal as a main component, and a material formed by plating a precious metal, including silver, gold, or platinum, on a surface of the one of the metal, the oxide containing the metal as the main component, or the alloy containing the metal as the main component.

15. A charging apparatus comprising:

a plurality of counter electrodes formed in a plate shape and arranged in a direction intersecting with a ventilation direction to allow respective surfaces thereof to follow the ventilation direction; and a plurality of high voltage electrodes formed in a wire shape and installed between the plurality of counter electrodes, wherein each of the plurality of high voltage electrodes comprise a cross section in which a corner of a rectangle has an arc shape, wherein each of the plurality of high voltage electrodes has an arc shaped corner having a curvature radius that is in a range of 5% to 50% of a length of a short side of the cross section.

16. A precipitator comprising:

a charger comprising a charging apparatus comprising:

a plurality of counter electrodes formed in a plate shape and arranged in a direction intersecting with a ventilation direction to allow respective surfaces thereof to follow the ventilation direction; and a plurality of high voltage electrodes formed in a wire shape and installed between the plurality of counter electrodes, wherein the plurality of counter electrodes comprises:

a first counter electrode having a first electrode area, and a second counter electrode having a second electrode area less than the first electrode area, wherein the first counter electrode and the second counter electrode are alternately arranged, and wherein the second counter electrode comprises a plurality of through holes; and a dust collector or a dust collection filter disposed in a leeward side of the charger and configured to collect charged suspended particles floating in an airflow passed through the charger.

17. The precipitator of claim 16, wherein the dust collector comprises a high voltage electrode formed in a plate shape and coated with a film formed of an insulating material; and a counter electrode formed in a plate shape having conductivity, wherein the high voltage electrode and the counter electrode are alternately stacked.

18. The precipitator of claim 16, wherein the dust collection filter is electret-processed.

19. The precipitator of claim 16, wherein the second counter electrode is configured such that an opening degree is higher in a leeward side than a windward side.

* * * * *